US008204395B2

(12) United States Patent
Hirai

(10) Patent No.: US 8,204,395 B2
(45) Date of Patent: Jun. 19, 2012

(54) WET DEVELOPMENT DEVICE, WET DEVELOPMENT METHOD, AND IMAGE FORMING APPARATUS USING THE DEVICE

(75) Inventor: Atsuto Hirai, Ikoma (JP)

(73) Assignee: Konica Minolta Holdings, Inc., Tokyo (JP)

( * ) Notice: Subject to any disclaimer, the term of this patent is extended or adjusted under 35 U.S.C. 154(b) by 399 days.

(21) Appl. No.: 12/462,075

(22) Filed: Jul. 28, 2009

(65) Prior Publication Data

US 2010/0040387 A1 Feb. 18, 2010

(30) Foreign Application Priority Data

Aug. 12, 2008 (JP) ..... 2008-207750

(51) Int. Cl.
*G03G 15/10* (2006.01)

(52) U.S. Cl. ..... 399/57; 399/53; 399/55; 399/240; 399/249

(58) Field of Classification Search ..... 399/53, 399/55, 57, 240, 249
See application file for complete search history.

(56) References Cited

U.S. PATENT DOCUMENTS

| | | | | |
|---|---|---|---|---|
| 5,781,827 | A * | 7/1998 | Shimada et al. | 399/55 |
| 2006/0110186 | A1 * | 5/2006 | Hirai | 399/237 |
| 2008/0069579 | A1 * | 3/2008 | Tabata et al. | 399/53 |

FOREIGN PATENT DOCUMENTS

| | | |
|---|---|---|
| JP | 2005-345932 | 12/2005 |
| JP | 2007-225893 | 9/2007 |

* cited by examiner

*Primary Examiner* — Ryan Walsh
(74) *Attorney, Agent, or Firm* — Brinks Hofer Gilson & Lione

(57) ABSTRACT

The invention provides a wet development device, wet development method and image forming apparatus having the device by which appropriate cleaning can be performed, the wear of the blade or developing roller can be reduced, and good images can be obtained without toner contamination even when the amount of toner for development or that of electric charge of the toner is changed for changing the density or gradation of image or type of paper. The toner in the developer is electrically charged to an arbitral charging amount by a discharging section and provided for the development and the charge of the toner is eliminated after development by that a discharging section is provided before cleaning the developer remaining on the developing roller and the output of the discharging section is appropriately controlled corresponding to the output of the discharging section.

17 Claims, 14 Drawing Sheets

WET DEVELOPMENT DEVICE, WET DEVELOPMENT METHOD, AND IMAGE FORMING APPARATUS USING THE DEVICE

This application is based on Japanese Patent Application No. 2008-207750 filed on Aug. 12, 2008, in Japanese Patent Office, the entire content of which is hereby incorporated by reference.

TECHNICAL FIELD

The invention relates to a wet development device, a wet development method and an image forming apparatus using the device, by which a toner image is formed by developing an electrostatic latent image formed on the surface of a photoconductor by using a developer carrying member for carrying a liquid developer containing toner and carrier liquid.

BACKGROUND

Electrophotographic image forming apparatuses are widely used, in which an electrostatic latent image is formed on a photoconductor (photoconductive drum) and toner is applied onto the latent image to form a toner image and the toner image is transferred and fixed onto paper. Particularly, a wet development method using liquid developer, which has relatively small size toner particles and seldom causes irregularity in images, is beginning to be used in image forming apparatuses required to have higher image quality and image resolution such as office printers for printing a lot of documents and on-demand printing apparatuses.

Recently, wet development devices and image forming apparatuses using a high viscous and high concentration liquid developer, which is prepared by dispersing solid toner component composed of a resin and a pigment in high concentration in an insulating liquid (carrier liquid) such as silicone oil, have been proposed.

When the development is carried out by using such liquid developer, it is usual that a micron order thin layer of developer is formed on a developer carrying member such as a developing roller and the thin-filmed developer is brought in contact with the photoconductor to develop.

In a common wet development method, the thin layer of the liquid developer is formed on the developing roller by a thin layer forming method in which an amount of carried developer is regulated with a blade, and the toner particles in the thin developer layer are then charged by a charging section provided on the upstream side in the developer carrying direction, and the latent image formed on the photoconductor in a facing position is developed in the development area.

However, the liquid developer is usually left on the developing roller after the development of the latent images on the photoconductor. When such remaining developer is again arrived at the development area, it creates a bad influence on the next image such as memory phenomenon.

Therefore, a technique for cleaning the developer remaining on the developing roller has been developed.

To clean the developer remaining on the photoconductor, it is usual that the developer is scrubbed off with a blade touching the photoconductor. Therefore, a technique by touching a blade to the developing roller for scrubbing off the developer remaining on the developing roller has been applied.

In the case of the developing roller, however, it is difficult to use a material of high hardness for the surface of the developing roller in view of the parts for supplying the developer and the photoconductor in contact. Thus, if the touching pressure of the blade is increased, the durability of the developing roller is decreased, and if the touching pressure is too low, the remaining developer is not satisfactory cleaned with the developer slipping through the blade.

To address the above problems, Japanese Laid-Open Patent Application Publication No. 2005-345932 discloses a technique for easily scrubbing off the toner by the blade, in which a toner releasing member is provided facing the developing roller, after the development area and before the cleaning area, and voltage is applied between the toner releasing member and the developing roller for electrically releasing the toner in the developer from the developing roller surface, so that the toner is easily scrubbed off by the blade.

In addition, Japanese Laid-Open Patent Application Publication No. 2003-225893 discloses a technique in which the toner is absorbed and removed by a cleaning roller applied with a bias voltage, before cleaning by the blade.

The removal of the remaining developer after development on the developing roller is influenced by the charge of the toner in the developer. To put it into anther words, when the toner is highly charged, the adhering force to the developing roller is accordingly high and the cleaning is accordingly difficult by the mechanical scrubbing force of the blade.

On the other hand, the highly charged toner is advantageous for inhibiting fog and image noise created at the time of development. Furthermore, the amount of adhered toner (image density) and the gradation (dependence of the toner adhering amount on the potential difference) can be controlled by changing the charging amount of the toner.

In the techniques disclosed in Japanese Laid-Open Patent Application Publication Nos. 2005-345932 and 2007-225893, the toner is electrically removed, after development, by the toner releasing member before the cleaning by the blade, but they have a problem that the cleaning cannot satisfactorily carried out since any measure to deal with variation in the charge of the toner is not provided.

SUMMARY

In view of forgoing, one embodiment according to one aspect of the present invention is a wet development device, comprising:

a developer carrying member for conveying thereon a liquid developer for developing an electrostatic latent image on an surface of an image carrying member into a toner image, to a developing area, the liquid developer containing the toner and carrier liquid;

a developer charging section with a variable output current provided on an upstream side with respect to the developing area in a moving direction of the developer carrying member so that the toner in the developer is charged before being subjected to development;

a developer discharging section with a variable output current provided on a downstream side with respect to the developing area in the moving direction of the developer carrying member so that the toner in the developer remaining on the developer carrying member is discharged after being subjected to the development;

a liquid developer removing section provided on a downstream side with respect to the developer discharging section in the moving direction of the developer carrying member for removing the liquid developer left on the developer carrying member after the toner is discharged by the developer discharging section; and a control section for setting the output current of the developer discharging section corresponding to the output current of the developer charging section.

According to another aspect of the present invention, another embodiment is a wet development method, comprising the steps of:

charging toner in a liquid developer on a developer carrying member by supplying electric current, the liquid developer containing the toner and carrier liquid;

conveying on the developer carrying member the liquid developer in which the toner has been charged in the step of charging toner, to a developing area;

developing an electrostatic latent image on a surface of an image carrying member into a toner image in the developing area, with the developer conveyed by the developer carrying member;

discharging the toner remaining in the liquid developer by supplying electric current, after the step of developing an electrostatic latent image; and removing the liquid developer remaining on the developer carrying member, after the step of discharging the toner, wherein the step of discharging includes the step of setting the electric current supplied in the step of discharging the toner, corresponding to the electric current supplied in the step of charging toner.

According to another aspect of the present invention, another embodiment is an image forming apparatus, comprising:

an image carrying member for carrying thereon an electrostatic latent image; and a wet development device for developing the electrostatic latent image on the image carrying member into a toner image, the wet development device including:

a developer carrying member for conveying thereon a liquid developer for developing the electrostatic latent image to a developing area, the liquid developer containing the toner and carrier liquid;

a developer charging section with a variable output current provided on an upstream side with respect to the developing area in a moving direction of the developer carrying member so that the toner in the developer is charged before being subjected to development;

a developer discharging section with a variable output current provided on a downstream side with respect to the developing area in the moving direction of the developer carrying member so that the toner in the developer remaining on the developer carrying member is discharged after being subjected to the development;

a liquid developer removing section provided on a downstream side with respect to the developer discharging section in the moving direction of the developer carrying member for removing the liquid developer left on the developer carrying member after the toner is discharged by the developer discharging section; and a control section for setting the output current of the developer discharging section corresponding to the output-current of the developer charging section.

DETAILED DESCRIPTION OF THE EMBODIMENT

Figure 1:
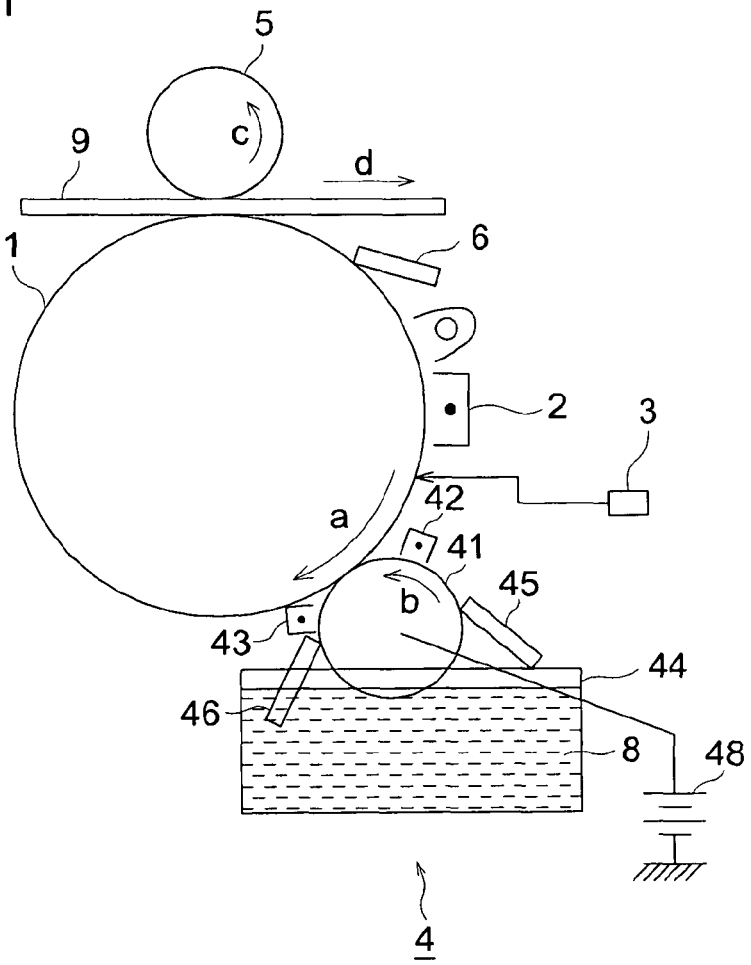
FIG. 1 shows an example of the entire structure of an image forming apparatus according to an embodiment of the invention.

The wet development devices and image forming apparatuses according to the embodiments of the invention are described below referring to the drawings.

Wet image forming apparatuses using a thin layer of developer are utilized as copy machines, simple printing machines or printers. In such apparatuses, an image forming process based on the electrophotographic system is commonly used. Firstly, the wet image forming apparatus based on the electrophotographic system is described referring to FIG. 1, and the structure, the functions, and the operations of the wet development device used in the apparatus will then be described.

(Examples of the Entire Structure and Functions of Image Forming Apparatus)

An example of the entire structure of the image forming apparatus according to the embodiments of the invention is shown in FIG. 1. The entire structure of the image forming apparatus is described referring to FIG. 1. Only the structural elements involved in the image forming process are shown in the drawing. The structural elements involved in supplying, conveying and ejecting of recording medium are simply shown.

An image forming apparatus 10 in FIG. 1 has a photoconductor drum 1 as the image carrying member, a charging device 2, an exposing device 3, a wet development device 4 and a cleaning device 6. The image forming apparatus has a transferring roller 5 as well.

Although only one wet development device 4 is illustrated in FIG. 1, a plurality of wet development devices may be provided for color image formation. Any method can be used for color development, an intermediate transfer member may be employed as desired, and they may be appropriately arranged.

The photoconductor drum 1 is a cylinder on the surface of which a photosensitive layer, not shown in the drawing, is provided, and the photoconductor drum 1 is rotated in the direction of the arrow "a" in FIG. 1. Around the photoconductor drum, the cleaning device 6, the charging device 2, the exposing device 3, the wet development device 4 and the transferring roller 5 are arranged in this order along the rotating direction of the photoconductor drum 1.

The charging device 2 charges the surface of the photoconductor drum 1 to a predetermined potential.

The exposing device 3 irradiates light to the surface of the photoconductor drum 1 so that the charge level in the irradiated area is lowered to form an electrostatic latent image.

The wet development device 4 develops the latent image formed on the photoconductor drum 1. The wet development device conveys the liquid developer to the development area and transfers the toner contained in the liquid developer to the electrostatic latent image on the surface of the photoconductor drum 1 to form a toner image.

In the developing process, developing bias voltage with the same polarity as the toner charge is applied from a power source 48 to the developing roller 41 of the wet development device 4. There is formed an electric field having an unevenness of strength between the toner and the latent image on the photoconductor having the same polarity as the toner, and the toner contained in the developer is electrostatically adsorbed onto the photoconductor drum 1 according to the latent image, so that the latent image on the photoconductor drum 1 is developed.

The transferring roller 5 is arranged so as to face the photoconductor drum 1 through the recording medium 9 in between and is rotated while being in contact with the recording medium 9. The toner image is transferred from the photoconductor drum 1 onto the recording medium 9 at the nip portion between the transferring roller 5 and the photoconductor drum 1.

The recording medium 9 is conveyed to the transferring position in the direction of the arrow "d" while in synchronism with the transfer of the toner image.

In the transfer process, bias voltage having the polarity reverse to that of the toner is applied to the transferring roller 5 from a power source not shown in the drawing. An electric field is generated between the transferring roller 5 and the photoconductor drum 1 by the application of a bias voltage, so that the toner image formed on the photoconductor drum 1 is electrostatically adsorbed and transferred onto the recording medium 9 passing through the portion between the transferring roller 5 and the photoconductor drum 1.

The recording medium 9 carrying the transferred toner image is conveyed to the fixing area, not shown in the drawing, and the toner constituting the toner image is pressed at a high temperature in the fixing area, so that the toner is fused and fixed on the recording medium 9.

After transferring the toner image to the recording medium 9, the toner remaining on the photoconductor drum 1 is removed by the cleaning device 6, and the next image formation is performed.

(Composition of Developer)

The liquid developer 8 to be used for the development is described below. The liquid developer is composed of a carrier liquid as a solvent and colored toner particles dispersed therein in high concentration. Additives such as a dispersing agent and a charge controlling agent may be appropriately added to the liquid developer.

A solvent which is electrically insulating and nonvolatile at the room temperature is used as the carrier liquid. Examples of the nonvolatile solvent include silicone oil, mineral oil and paraffin oil.

The toner particles are mainly composed of resin and pigment or dye for coloring. The resin has a function to disperse the pigment or the dye therein and a function as binder to be used when fixed on a recording medium.

Examples of the resin include a thermoplastic resin such as polystyrene resin, styrene-acryl resin, acryl resin, polyester resin, epoxy resin, polyamide resin, polyimide resin, an polyurethane resin. Plural types of the resin may be used as a mixture.

Pigments and dyes on the market can be used to color the toner. Examples of the pigment include carbon black, red iron oxide, titanium oxide, silica, phthalocyanine blue, phthalocyanine green, sky blue, benzidine yellow, and Lake Red D. Solvent Red 27 and Acid Blue 9 can be used as the dye.

The liquid developer can be prepared by a commonly used method. For example, the resin and the pigment are melted and kneaded at a predetermined ratio by a pressing kneader or a roller mill to uniformly disperse, and thus obtained dispersed matter is finely crushed in a jet mill. Colored toner having a predetermined particle size can be obtained by classifying the resultant fine powder with a classifying machine such as a wind classifier.

Then the obtained toner is mixed with the insulating liquid as the carrier liquid at a predetermined ratio. The mixture is then processed to be well dispersed using a dispersing device such as a ball mill, and whereby liquid developer is obtained.

The volume average particle diameter of the toner is appropriately within the range from 0.1 μm to 5 μm. The developing ability of the toner is considerably lowered when the average particle diameter is less than 0.1 μm. Besides, image quality is degraded when the average particle diameter exceeds 5 μm.

The appropriate ratio of the toner particles to the liquid developer is approximately from 10 to 50% by mass. When the ratio is less than 10%, the toner particles tend to precipitate, and an issue of stability during prolonged storage time tends to occur. Moreover, consumption of large amount of the developer is required to obtain required density image so that an issue of cost is caused. When the ratio exceeds 50%, the viscosity of the liquid developer is made too high, and difficulty is caused in the production and handling.

The viscosity of the liquid developer is preferably from 0.1 mPa·s to 10,000 mPa·s at 25° C. When the viscosity is more than 10,000 mPa·s, stirring and transportation of the developer are made difficult, and the load on the production apparatus of the developer is increased.

The First Embodiment

Structure and Functions of Wet Development Device

The structure and function of the wet development device 4 shown in FIG. 1 according to the first embodiment of the invention is described below.

The liquid developer 8 is contained in a developer tank 44. In the liquid developer 8, the toner particles are dispersed in the carrier liquid as the solvent as above-mentioned.

A developing roller 41 as the developer carrier is arranged such that the roller is immersed in the liquid developer 8 in the developer tank 44 and rotated in the direction of the arrow "b" to draw up the liquid developer 8 from the developer tank 44. The high viscous liquid developer 8 is transported adhering to the surface of the developing roller 41 by sticking force thereof.

A regulating member 45 is arranged to be in touch with the developing roller 41 to regulate the amount of the developer transported on the developing roller 41 adhering on the surface thereof. The excessive liquid developer is scrubbed off, so that a thin layer of the liquid developer is formed on the developing roller and transported.

A rubber roller having low hardness is used as the developing roller 41.

An electric charger 42 is arranged to be faced to the developing roller 41 and gives electric charge to the toner in the thin layer of the liquid developer on the surface of the developing roller 41 to assist the following developing process by raising the charging amount of the toner. The charger 42 functions as a developer charging section.

The developing roller 41 is rotated while also touching the photoconductor drum 1 as the image carrier, and the thin layer of the liquid developer is transported to the nip portion between the developing roller 41 and the photoconductor drum 1, namely the development area, after charging by the charger 42 to develop the latent image on the photoconductor drum 1.

Figure 2B:
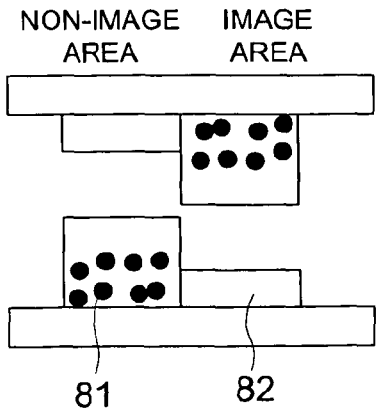
FIG. 2*b* shows the situation of the nip portion between the photoconductor and the developing roller after separation of the photoconductor and the developing roller.
Figure 2A:
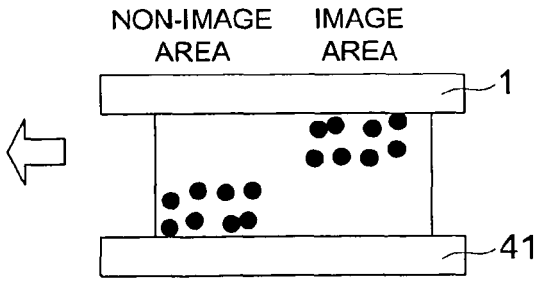
FIG. 2*a* shows the situation of the nip portion between a photoconductor and a developing roller on the occasion of development.

The behavior of the toner particles in the development area is described referring to FIGS. 2*a* and 2*b*. FIG. 2*a* displays the situation of the photoconductor drum 1 and the developing roller 41 at the nip portion at the time of development. FIG. 2*b* displays the situation of the photoconductor drum 1 and the developing roller 41 at the nip portion when they are separated after the development.

In FIG. 2*a*, the latent image having charge of the same polarity as that of the toner particles is formed on the surface of the photoconductor drum 1, and the potential is lower in the image area, and higher in the non-image area.

The developing roller 41 is applied with a potential between the potential in the image area and that in the non-image area. In the development area, the toner particles 81 in the image area and those in the non-image area are each moved to the photoconductive drum 1 side and the developing roller 41 side, respectively.

After that, the liquid developer in the nip portion is divided onto the photoconductor drum side and the developing roller side when the photoconductor drum 1 is separated from the developing roller 41.

As a result, on the surface of photoconductor drum 1 the toner particles 81 and the carrier liquid 82 adhere to the image area, and the carrier liquid 82 solely adheres to the non-image area. Vice versa, on the surface of developing roller 41, the carrier liquid 82 is solely remains in the area corresponding to the image area of the photoconductor drum 1, and the toner particles 81 and the carrier liquid 82 remain in the area corresponding to the non-image area of the photoconductor drum 1.

As above-mentioned, the thin layer of developer remains on the surface of developing roller 41 after development of a latent image on the photoconductor drum 1. The following development suffers bad influence if the remaining developer, without being removed, is conveyed again to the development area. A cleaning member 46 is a blade for cleaning the developing roller 41, and the remaining developer is removed by the blade. The cleaning member 46 functions as a developer removing section.

In this embodiment, a discharging charger 43 is provided between the development area of the photoconductor drum 1 and the cleaning member 46. The discharging charger is provided to help the cleaning member to clean, by eliminating the charge of the toner particles in the developer remaining on the surface of developing roller 41 to reduce the adhering force between the developing roller 41 and the toner particles 81 in the developer. The discharging charger 43 functions as a developer discharging section.

The remaining developer removed by the cleaning member 46 is recovered into the developer tank 44. However, the recovered developer is different from the original developer 8 in terms of toner concentration. A section for detecting the concentration such as toner concentration sensor (not shown in the drawing) is provided in the developer tank 44 to control the toner concentration of the liquid developer in the developer tank 44 so as to be within a predetermined range.

As a section for detecting the concentration, known sensors utilizing optical detection and stirring torque can be used as desired. The toner concentration of the liquid developer 8 can be maintained within the certain range by replenishing concentrated developer or carrier liquid.

A section for detecting an amount of developer or a section for stirring the liquid developer may be provided in the developer tank 44.

A charger is used as the developer charging section and the developer discharging section, otherwise the developer layer may be applied with a voltage through a conductive film.

In the above, the direct transfer from the photoconductor 1 to the recording medium 9 such as paper is described, but the wet development device is also applicable to a system using an intermediate transfer member. A developing belt can also be used in place of the developing roller 41.

(Charging and Discharging of the Developer Layer)

As above-mentioned, the wet development device of this embodiment has a structure in which the output current of the developer discharging section supplied to the remaining developer layer after development and before removal is controlled depending on the output current of the developer charging section supplied to the developer layer before development.

An example of controlling the output current of the developer charging section to control the image density, and an advantage of controlling the output current of the developer discharging section depending on the output current of the developer charging section and the flow of controlling the developer discharging section is described below.

<Image Density Control>

A process for controlling the image density through an operation panel is described below.

In the case where the toner in the liquid developer layer formed on the developing roller 41 is charged by the charging charger 42, when the output current of the charging charger 42 (the electric current flown into the developing roller 41 from the charging charger 42) is changed, the charging amount of the toner particles is changed, and whereby the amount of toner forming the developed image on the photoconductor 1 is changed.

Figure 3:
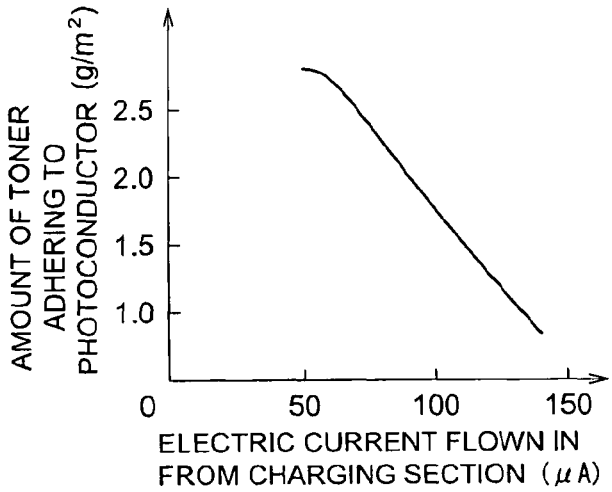
FIG. 3 shows a graph showing a relationship between the variation in the amount of the toner adhered to the photoconductor and the current from the discharging section.
Figure 4:
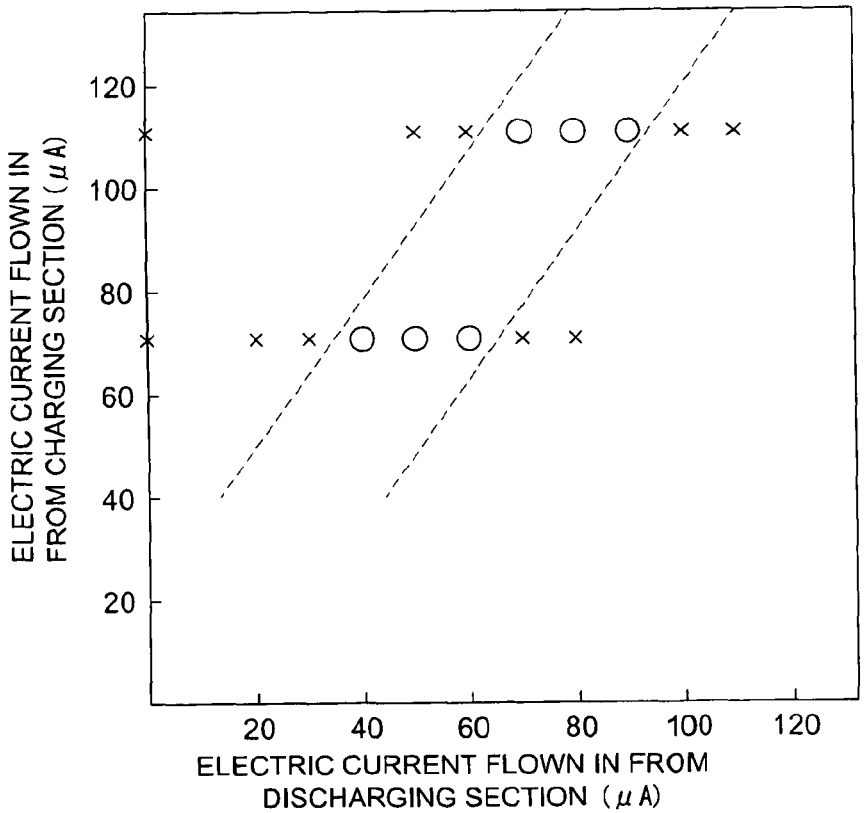
FIG. 4 shows cleaning ability of toner with respect to the different currents of a discharging section and the different currents of a discharging section.

FIG. 3 is a graph showing the relationship between the amount of toner adhering to the photoconductor and the electric current flown from the charging section. The amount of toner for development on the photoconductor, in other words, the amount of adhering toner is decreased when the charging amount of the toner is increased. Change in the adhering amount of toner causes change in the amount of toner to be transferred onto the recording medium, and the image density on the recording medium is changed.

As described above, the image density can be controlled by operation on the operation panel by the operator provided that the apparatus is constituted so that the output current of the charging charger 42 is controlled by signals from the operation panel operated by the operator.

<Output Current of Discharging Corresponding to Output Current of Charging>

The reason for the discharging charger 43 to be provided is to facilitate the cleaning of developer (particularly the toner) remaining on the developing roller 46.

The removal of the developer remaining on the developing roller after development is influenced by the charge amount of the toner in the developer. The adhering force of the toner to the developing roller is increased with rising of the charge amount of the toner, and whereby it becomes difficult to clean the developer roller by the blade by using the mechanical scrubbing force.

Besides, the amount of adhering toner (image density) and the gradation (relationship between the amount of adhering toner and the potential difference) are controlled by changing the output current of charging.

It is not enough to just discharge the remaining developer, but it is important to appropriately discharge. For instance, the charge amount of toner is changed corresponding to the variation of the output (the current flown into the developing roller 41 from the charging charger 42 is referred to as "output") of the charging charger 42. Therefore, it is necessary that the output (the current flown into the developing roller 41 from the charging eliminating charger 43 is referred to as "output") of the discharging charger 43 is appropriately controlled depending on the variation of the charging amount of toner charged by the charging charger 42.

Although an example is described later as a concrete example of the conditions, the dependency of the cleaning property on the output of the discharging section and the output of the discharging section.

The Y-axis denotes the output of the charging section which charges toner in a positive polarity, and the X-axis denotes the output of the discharging section which supply minus charge to toner. The cleaning ability is classified into A and B, depending on the visually observed residual toner after cleaning.

For example, a lot of toner remains on the developing roller 41 when the output of the charging charger is 70 μA and that of the discharging charger 43 is 0. When the output of the discharging charger is increased from such a situation, the amount of the remaining toner is lowered to nothing (when the output is from 40 to 60 μA). When the output is further increased, the remaining toner appeared again (when the output is 80 μA). Therefore, it is understood that there is an optimum value in the output of the discharging charger 43.

It is understood that the optimum output of the discharging charger 43 is shifted to higher side (70 to 90 μA) when the output of the charging charger 42 is increased (110 μA) to control the image density on the recording medium 9. Thus, it is necessary to change the output of the discharging charger 43 when the output of the charging charger is changed.

<Control Flow of Charge and Discharge>

Figure 5:
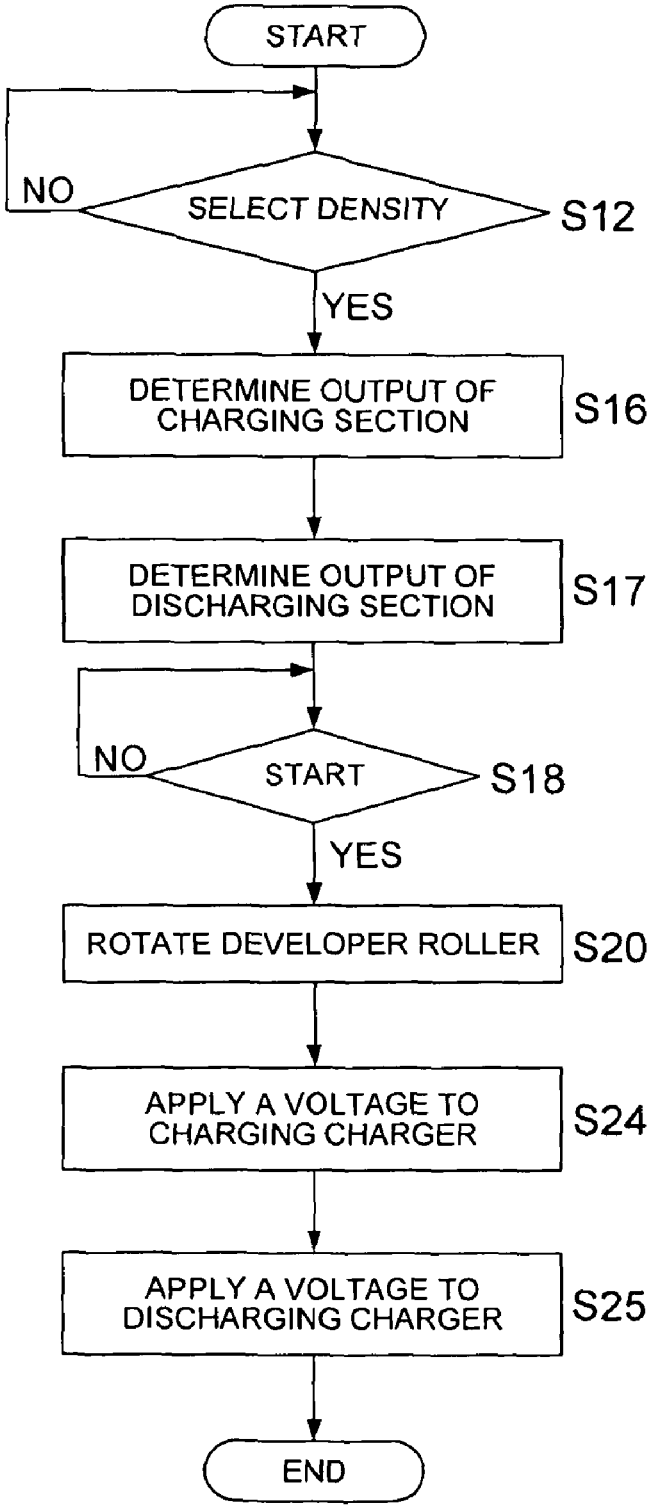
FIG. 5 is a flowchart showing a control flow of charge and discharge of the developer layer, in the wet development device according to the first embodiment of the invention.
Figure 6:
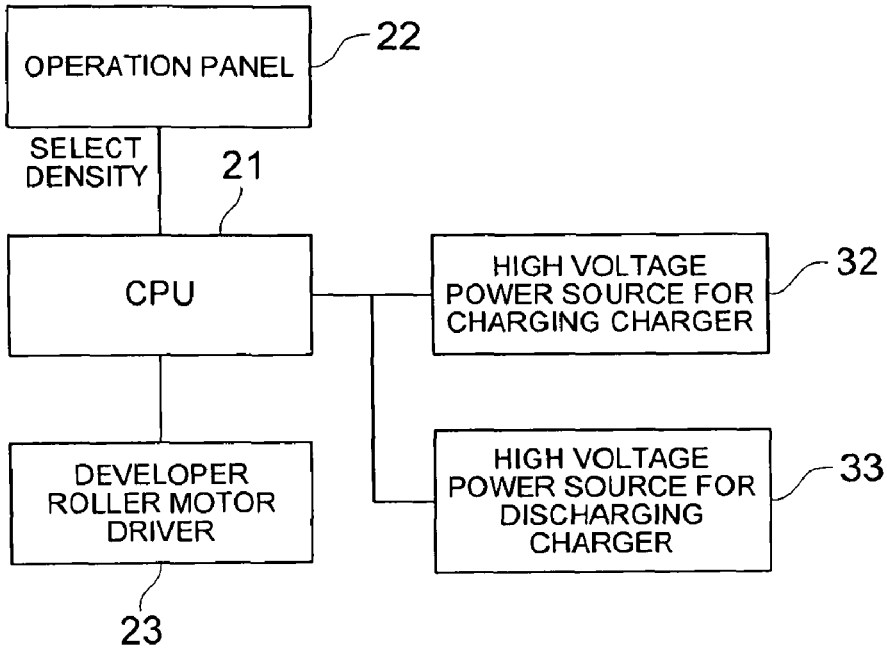
FIG. 6 is a block diagram showing the functional structure of controlling of charging and discharging of the developer layer, in the wet development device according to the first embodiment of the invention.

The control flow of the charge and the discharge is described referring to FIGS. 5 and 6. FIG. 5 is a flowchart illustrating the control flow of charge and discharge of the developer layer on the developing roller in the wet development device according to the first embodiment. FIG. 6 is a block diagram illustrating the functional structure of the control operation.

In step of S12, a CPU 21 judges whether the image density is selected by the operator on the operation panel. When the density is selected, the CPU 21 obtains such a selection and sets the developer amount at a predetermined value corresponding to the selection. Which means that the CPU 21 functions as a toner amount setting section. When the density is not selected, the CPU 21 repeats step S12 and wait for an operation of the operator.

In step S16, the CPU 21 determines the output of the charging charger 42 based on the developer amount set in step S12.

In step S17, the CPU21 determines the output of the discharging charger 43 based on the output of the charging charger 42.

In step S18, the CPU 21 judges whether the operator operates the operation panel 22 to start image formation, and when the start is instructed, the CUP 21 obtains a start-signal. When the start of image formation is not instructed, the CPU 21 repeats step S18 and wait for an operation of the operator.

In step S20, the CPU21 controls a developer roller driver 23 to start the driving of the developer roller 41 in response to the start-signal.

In step S24, the CPU 21 determines the voltage of a high voltage power source 32 for the charging charger based on the determined output of the charging charger 42 and controls the power source 32 to apply the voltage to the charging charger 42.

In step S25, the CPU 21 determines the voltage of a high voltage power source 33 for the discharging charger based on the determined output of the discharging charger 43 and controls the power source 33 to apply the voltage to the discharging charger 43. The timing of driving the discharging charger 43 is controlled in synchronism with the timing of driving the charging charger 42 in a way that the discharging charger 43 is driven when the charged toner is arrived at the position of the discharging charger 43.

As described above, the control flow of the charge and the discharge of the developer layer on the developing roller is performed. After that, the operation may be finished with any optional process executed. As understood from the above, the CUP21 functions as a control section.

The Second Embodiment

Structure and Functions of Wet Development Device

As a wet development device according to the second embodiment of the invention, the structure and the functions of the wet development device 4 in FIG. 1 are described focusing on the different parts from the first embodiment.

In the first embodiment, the structure in which the operator adjusts the image density on the operation panel is described. In some cases, however, the toner amount appropriate to form an image of the same density is different depending on a type of paper to be used as a recording medium.

For instance, the amount of toner necessary for covering the paper having a smooth surface such as coated paper is small. In contrast, larger amount of toner is required to cover paper having a rough surface such as high quality paper. When an image is printed on high quality paper with toner of the amount appropriate to print an image on coated paper, the surface of the paper cannot be completely covered with the toner, so that the surface of the paper is partially exposed and the image is not made uniform. When the toner amount determined for high quality paper is applied to coated paper, the toner is excessive, and there may be a problem that the density is made too high and the width of the character or line is made too thick.

Thus, the amount of toner needs to be controlled depending on a type of recording paper. In concrete, amounts of 1.5 $g/m^2$ and 2.5 $g/m^2$ are appropriate for coated paper and high quality paper, respectively.

The second embodiment has a structure in which the amount of toner for development is adjusted based on a type of paper. After determining the amount of toner for development, toner is actually adjusted (by changing the output of developer charging section) to the determined amount in the same way as the first embodiment.

<Functional Structure>

Figure 8:
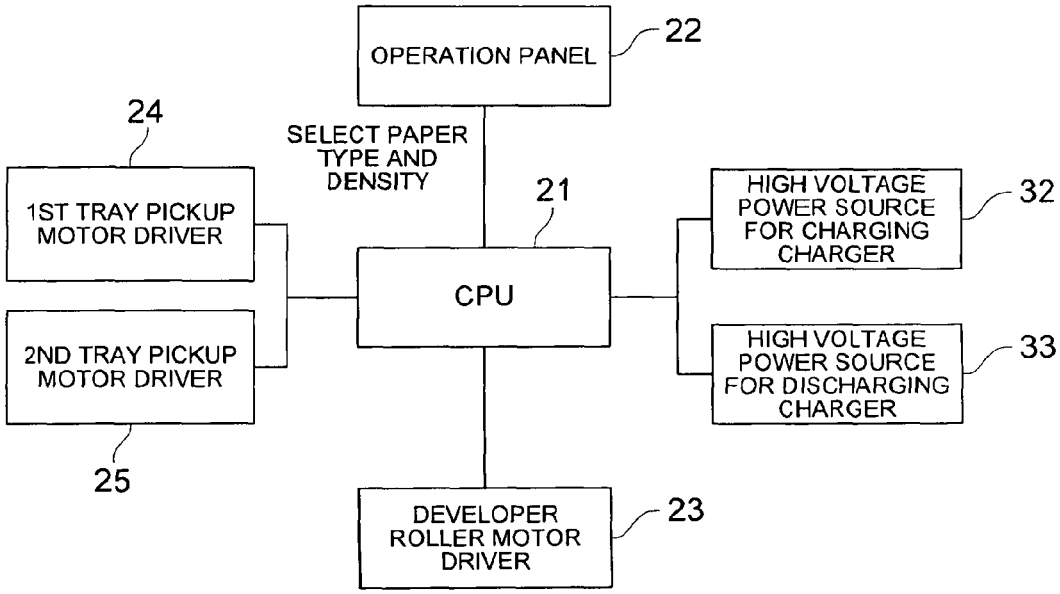
FIG. 8 is a block diagram showing the functional structure of control of charging and discharging of the developer layer, in the wet development device according to the second embodiment of the invention.

FIG. 8 is a block diagram showing the functional structure of the charge and the discharge of the developer layer on the developing roller in the wet development device according to the second embodiment. The structural elements assigned with the same reference numerals as the first embodiment have the same functions as the first embodiment.

The CPU 21 obtains a type of paper selected by the operator on the operation panel 22. The CPU21 functions as a recording sheet type obtaining section. The operator can adjust the image density on the operation panel 22; the CPU 21 also obtains the information of the image density to determine the amount of toner for development. Therefore, the CPU 21 functions as a developing toner amount settling section for determining the amount of toner for development.

The CPU21 executes, as the control section and in the same way as the first embodiment, the operation for adjusting the output of the charging section so as to set the amount of toner for development transferred onto the photoconductor 1 to the determined amount.

The first tray pickup motor driver 24 is a device for driving the motor for supplying paper from the first tray containing coated paper sheets, and the second tray pickup motor driver 25 is a device for driving the motor for supplying paper from the second tray containing high quality paper sheets.

<Control Flow of Charge and Discharge>

Figure 7:
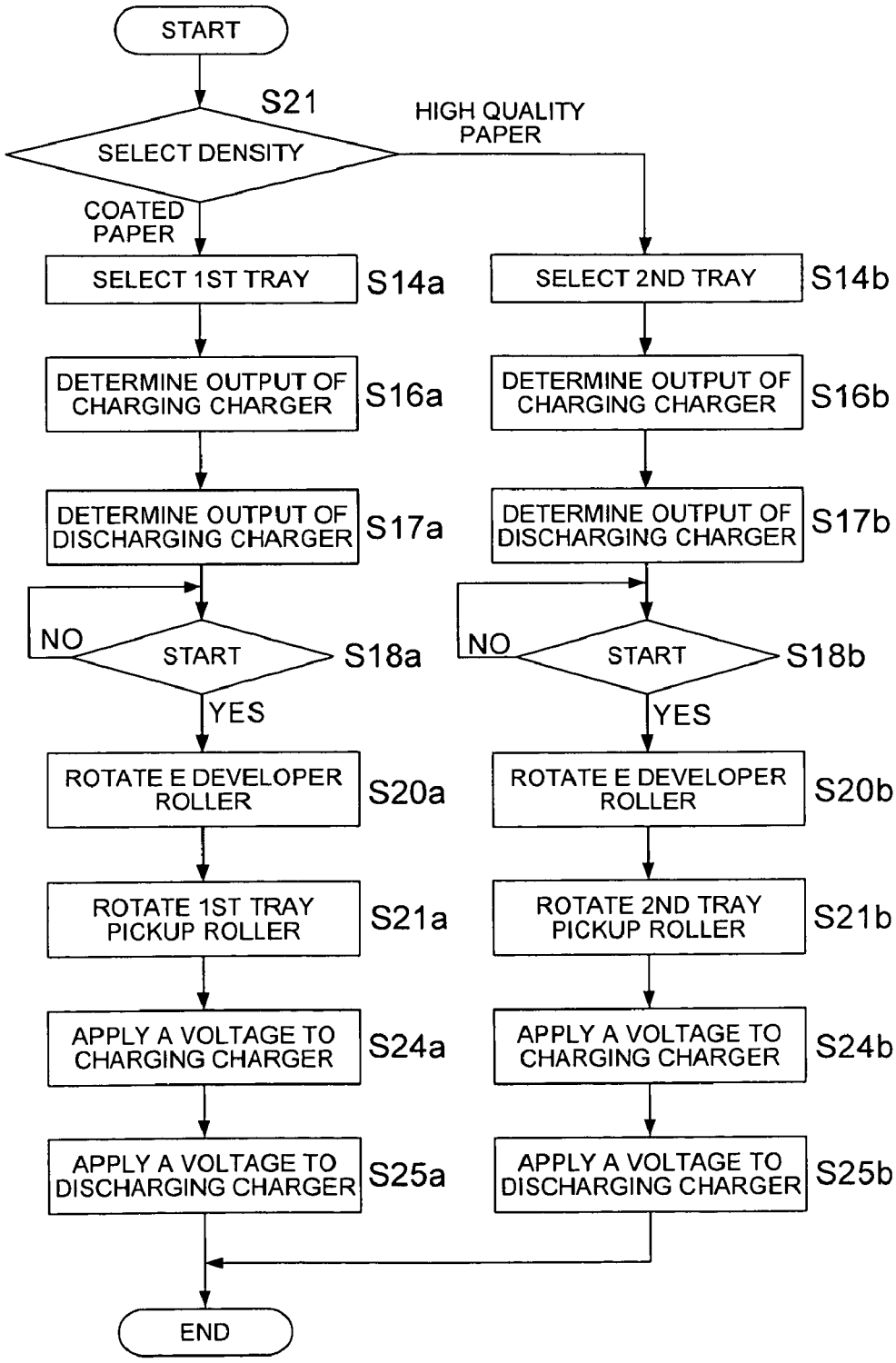
FIG. 7 is a flowchart showing a control flow of charging and discharging of the developer layer, in the wet development device according to a second embodiment of the invention.

The flow of the charge and the discharge is described referring to FIG. 7. FIG. 7 is a flowchart illustrating the flow of controlling the charge and the discharge of the developer layer on the developing roller in the wet development device according to the second embodiment.

In step S21 what type of recording paper is selected by the operator on the operation panel 22, and the CPU 21 obtains the type. The CPU 21 determines the amount of toner for development based on the type of paper.

When coated paper is selected on step S21, the step S14*a* and the followings are performed, and when the high quality paper is selected, the step S14*b* and followings are performed. In the following description of the flow, coated paper represented by "a" and high quality paper represented by "b" are collectively described, and "a" and "b" are attached only when they are necessarily to be distinguished from each other.

In step S14, the CPU 21 selects the first tray (in the case of coated paper) or the second tray (in the cases of high quality paper) based on the obtained information of the type of recording paper.

In step S16, the CPU 21 determines the output of the charging charger 42 based on the determined developing toner amount.

In step S17, the CPU 21 determines the output of the discharging charger 43 based on the determined output of the charging charger 42.

In step S18, the CPU 21 judges whether the operator operates the operation panel 22 to start image formation, and when the start is instructed, the CUP 21 obtains a start-signal. When the image formation start is not instructed, the CPU 21 repeats step S18 and wait for an operation of the operator.

In step S20, the CPU21 controls a developer roller driver 23 to start the driving of the developer roller 41 in response to the start-signal.

In step S21*a*, the CPU 21 controls the first tray pickup motor driver 24 to rotate the first tray pickup roller to start supply of coated paper.

In step of S21*b*, the CPU 21 controls the second tray pickup motor driver 25 to rotate the second tray pickup roller to start supply of high quality paper.

In step S24, the CPU 21 determines the voltage of a high voltage power source 32 for the charging charger based on the determined output of the charging charger 42 and controls the power source to apply the voltage to the charging charger 42.

In step S25, the CPU 21 determines the voltage of a high voltage power source 33 for the discharging charger 43 based on the determined output of the discharging charger 43 and controls the power source to apply the voltage to the discharging charger 43.

As described above, the control flow of the charge and the discharge of the developer layer on the developing roller is performed. After that, the operation may be finished with any optional process executed.

The Third Embodiment

Structure and Functions of Wet Development Device

As a wet development device according to the third embodiment of the invention, the structure and the functions of the wet development device 4 in FIG. 1 are described focusing on different parts from the first and second embodiments.

The second embodiment has the structure in which a type of recording paper is selected on the operation panel by the operator. However, a type of paper can be obtained by sensing, using a sensor, the recording paper to be used as a recording medium. As a sensor used for that purpose, a known sensor which measures the surface roughness using laser or airtightness can be used.

The third embodiment has a structure in which a type of the paper on the paper supply tray is detected by a sensor, and the type is used for determining the amount of toner for development. After determining the amount of toner for development, the amount of toner is actually adjusted (by adjusting the output of the developer charging section) to the determined amount in the same way as the first and the second embodiment.

<Functional Structure>

Figure 10:
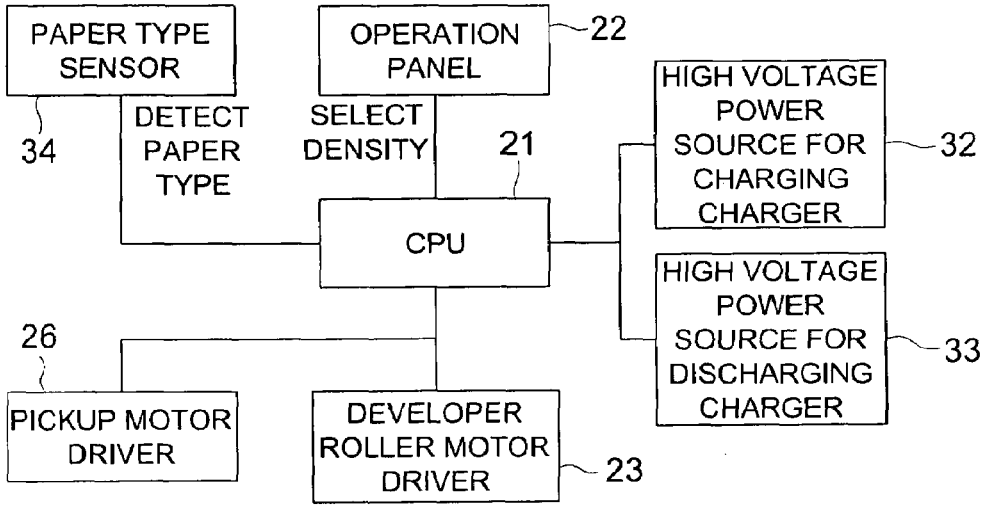
FIG. 10 is a block diagram showing the functional structure of control of charging and discharging of the developer layer in the wet development device according to the third embodiment of the invention.

FIG. 10 is a block diagram illustrating a functional structure of the controlling functions for charge and discharge of the developer layer on the developing roller in the wet development device according to the third embodiment. The structural elements each assigned with the same reference numerals as in the first and second embodiments have the same functions as those elements thereof.

The pickup motor driver 26 is a device for driving a motor for supplying paper to be used for image formation, from the tray containing the paper sheets.

The paper type detecting sensor 34 detects a type of paper, and the CPU 21 obtains the type of paper from the detection result. The CPU 21 functions as a paper type obtaining section.

The image density is selected by the operator on the operation panel 22. The CPU 21 sets the amount of toner for development based on the selected image density and the obtained type of paper. The CPU 21 functions as a developing toner amount settling section for settling the amount of toner for development based on the type of paper.

Similarly to the first and second embodiments, the CPU 21 performs and controls the operation for changing the output of the developer charging section so that the predetermined amount of toner is supplied on the photoconductor.

<Control Flow of Charge and Discharge>

Figure 9:
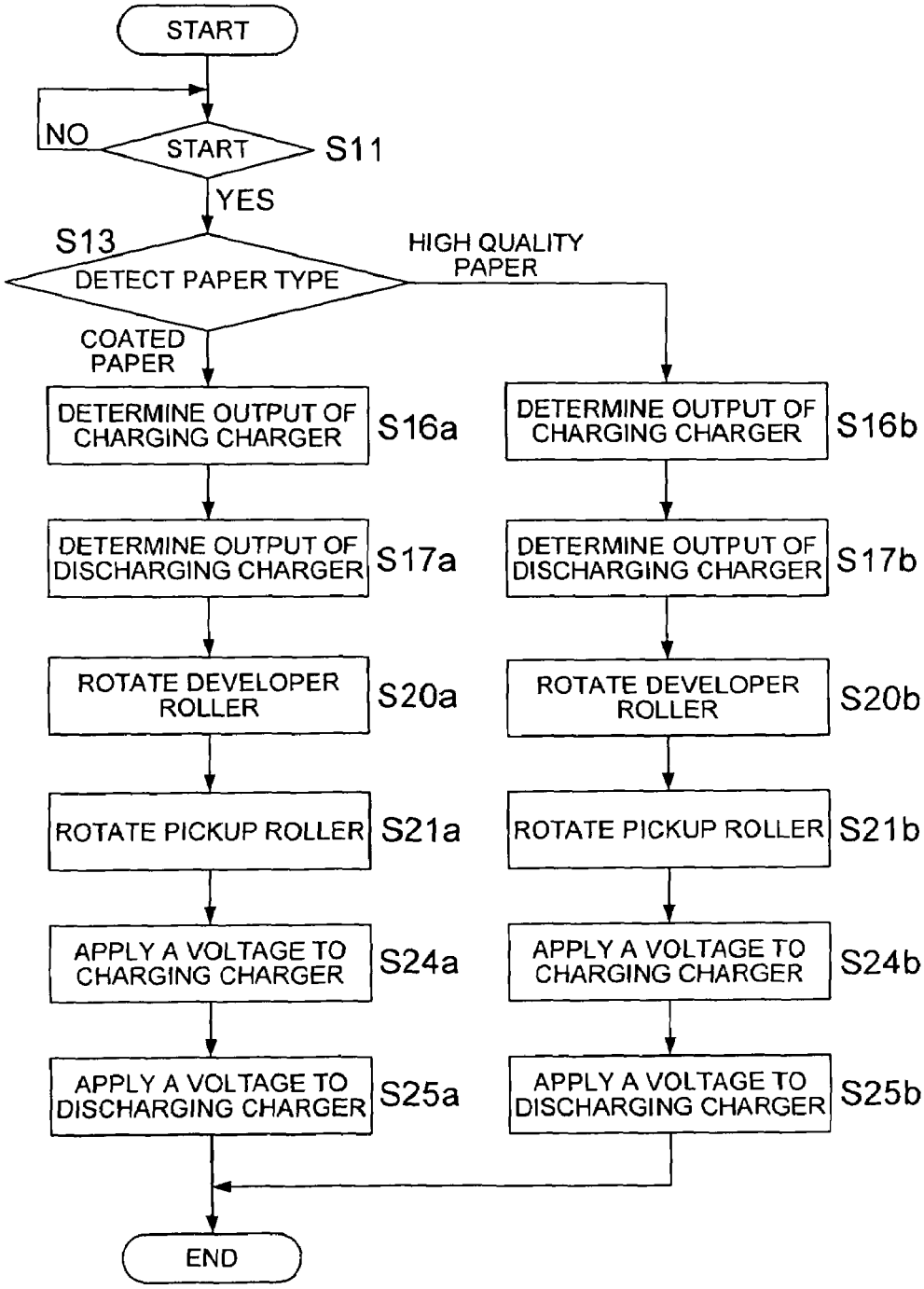
FIG. 9 is a flowchart showing a control flow of charge and discharge of the developer layer in the wet development device according to a third embodiment of the invention.

The control flow of the charge and the discharge is described referring to FIG. 9. FIG. 9 is a flowchart illustrating the flow of control of the charge and discharge of the developer layer on the developing roller in the wet development device according to the third embodiment.

In step S12, the CPU 21 judges whether the operator operates the operation panel 22 to start the image formation and obtains the starting signal when the starting operation is carried out and performs step S13 and the following steps. When the operation for starting is not carried out, the CPU 21 repeats step S12 for an operation of the operator.

In step S13, the paper type sensor 34 detects the paper on the paper supplying tray and the CPU 21 obtains the type of paper. The CPU 21 determines the amount of toner for development based on the obtained type of paper.

Step S16*a* and the following steps are performed when the selected paper is coated paper, and step S16*b* and the following steps are performed when the selected paper is high quality paper. In the following description of the flow, coated paper represented by "a" and high quality paper represented by "b" are collectively described and "a" and "b" are attached only when they are necessarily to be distinguished from each other.

In step S16, the CPU 21 decides the output of the charging charger 42 depending on the determined a mount of toner for development.

In step S17, the CPU 21 determines the output of the discharging charger 43 depending on the determined output of the charging charger 42.

In step S20, the CPU21 controls a developer roller driver 23 to start the driving of the developer roller 41.

In step S21, the CPU 21 controls the pickup motor driver 26 driving the paper supplying tray to be used for the image formation to rotate the pickup motor to start supply of the coated paper (in the case "a") or the high quality paper (in the case "b").

In step S24, the CPU 21 determines the voltage of a high voltage power source 32 for the charging charger depending on the determined output of the charging charger 42 and controls the power source to apply the voltage to the charging charger 42.

In step S25, the CPU 21 determines the voltage of a high voltage power source 33 for the discharging charger 43 depending on the decided output of the discharging charger 43 and controls the power supply to apply the voltage to the discharging charger 43.

As described above, the control flow of the charge and the discharge of the developer layer on the developing roller is performed. After that, the operation may be finished with any optional process executed.

The Fourth Embodiment

Structure and Functions of Wet Development Device

A different wet development device from the wet development device 4 in FIG. 1 is described as the fourth embodiment of the invention.

In the first to third embodiments, the developing roller draws up the liquid developer 8 from the developer tank 44. The fourth embodiment has a drawing up roller and a supplying roller, and the liquid developer is supplied by them.

The control of the amount of the developer layer to be supplied onto the developer roller is made easier with this arrangement, and the amount of the toner can be controlled by adjusting the amount of the developer supplied for development. Therefore, it is made possible that almost all the amount of the developer on the developing roller can be used for the development and the amount of the developer remaining on the developing roller can be reduced.

Figure 11:
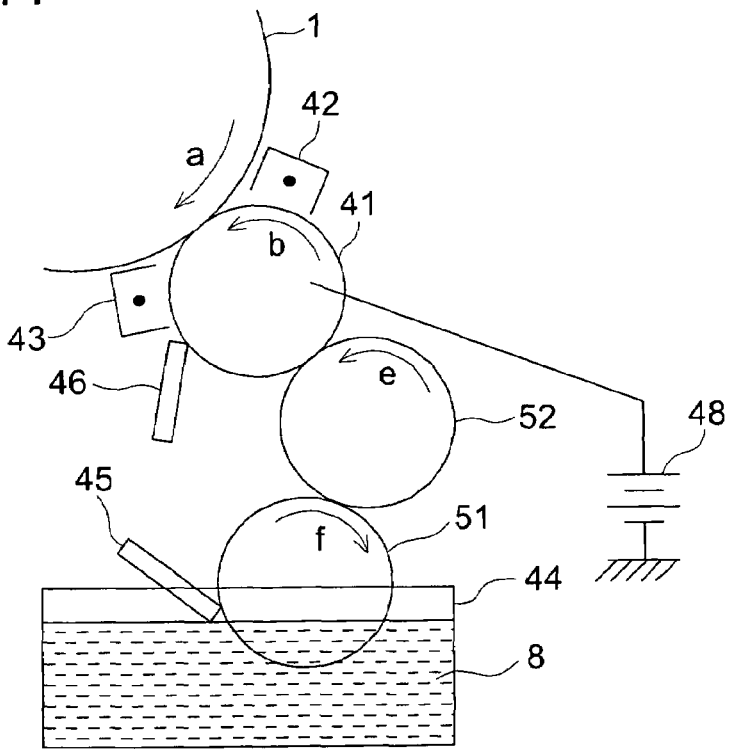
FIG. 11 is a diagram showing the schematic structure of a wet development device according to a fourth embodiment of the invention.

FIG. 11 is a schematic diagram showing the wet development device according to the fourth embodiment of the invention. The structure and the functions of the wet development device according to the fourth embodiment are described referring to FIG. 11.

The same reference numerals as in the first to third embodiments are assigned to the structural elements each having the same function as those in the first to third embodiments, respectively. The structure and functions different from those in the first to third embodiments are described below.

In FIG. 11, a supplying roller 52 for supplying the developer to the developing roller 41 and a drawing up roller 51 for drawing up the liquid developer 8 in the developer tank 44 are provided additionally to the developing roller 41.

The drawing up roller 51 is an anilox roller having uneven surface and arranged to be immersed in the liquid developer 8 in the developer tank 44 and rotated in the direction of the arrow "f" to draw up the liquid developer 8 from the developer tank 44.

A regulating member 45 is arranged in contact with the drawing up roller 51 and regulates the amount of the developer adhered on and transported by the drawing up roller 51.

The supplying roller 52 is faced to and in contact with the drawing up roller 51 and rotated in the direction of the arrow "e". The thin layer of the developer formed on the drawing up roller 51 is transferred onto the surface of supplying roller 52 at the nip portion and conveyed to the developing roller 41.

The developing roller 41 is arranged to be faced to and in contact with the supplying roller 52 and rotated in the direction of the arrow "b". The thin layer of developer conveyed on the surface of supplying roller 52 is scrubbed off by the developing roller 41 at the nip portion, and the thin layer of developer is transferred onto the surface of developing roller 41.

The moving direction of the surface of the developing roller 41 is opposite to the moving direction of the surface of the supplying roller 52. A uniform layer of the liquid developer is formed on the developer roller 41 by such an arrangement. Almost all of the developer on the supplying roller is transferred onto the developing roller 41 to improve the efficiency.

In such an arrangement, the amount of the developer supplied to the developing roller 41 per unit time can be changed by changing the rotation speed of the supplying roller 52, so that the control of the amount of liquid developer on the developing roller 41 is made possible. The supplying roller is driven by the supplying roller 52, and the rotation speed of the drawing up roller 51 is changed by changing the rotation speed of the supplying roller 52. In concrete, the amount of liquid developer on the developing roller 41 is increased by raising the rotation speed of the supplying roller 52.

In the case where the amount of liquid developer on the developing roller 41 is changed by changing the rotation speed of the supplying roller 52, the charge amount per toner particle on the developing roller 41 is changed when the output of the charging charge 42 is fixed. In concrete, the charge amount of the toner particle is lowered when increasing the amount of toner adhering to the developing roller 41 when the output of the charging charger 42 is fixed.

The charge amount of the toner on the developing roller 41 is necessarily larger than a certain value since problems such as deformation of characters, lines and dots are posed when the charge amount of the toner on the developing roller 41 is low. It is necessary, therefore, that the output of the charging charger 42 is increased when the amount of toner adhering to the developing roller 41 is increased.

Example of the relationship among the set amount of toner for development for each of the types of recording paper, the amount of the developer supplied by the supplying roller 52, and the output of the charging charger 42 is described below (the conditions are described in later-mentioned examples).

The amount of the necessary toner is 1.5 g/m$^2$ for coated paper and 2.5 g/m$^2$ for high quality paper, and the rotation speed of the supplying roller 52 needs to be controlled at 440 mm/s and 730 mm/s in line speed, respectively.

on such an occasion, the amount of electric current flown into the charging charger 42 is set at 40 μA for coated paper and 70 μA for high quality paper.

Corresponding to the above, the amount of electric current flown into the developing roller from the discharging charger 43 is controlled to be 30 μA for the coated paper and 50 μA for the high quality paper.

Thus, the cleaning ability of the developer remaining on the developing roller 41 can be kept high even when the toner amount on the developing roller 41 is changed depending on the type of paper.

The control of the density by the operator through the operation panel can be also carried out by changing the rotation speed of the supplying roller 52. Of course, the control of the output of the charging charger 42 and that of the discharging charger 43 need to be adjusted depending on the rotation speed.

As described above, the supplying roller 52 functions as a variable-supply-amount developer supplying section which supplies developer to the developing roller.

<Functional Structure>

Figure 13:
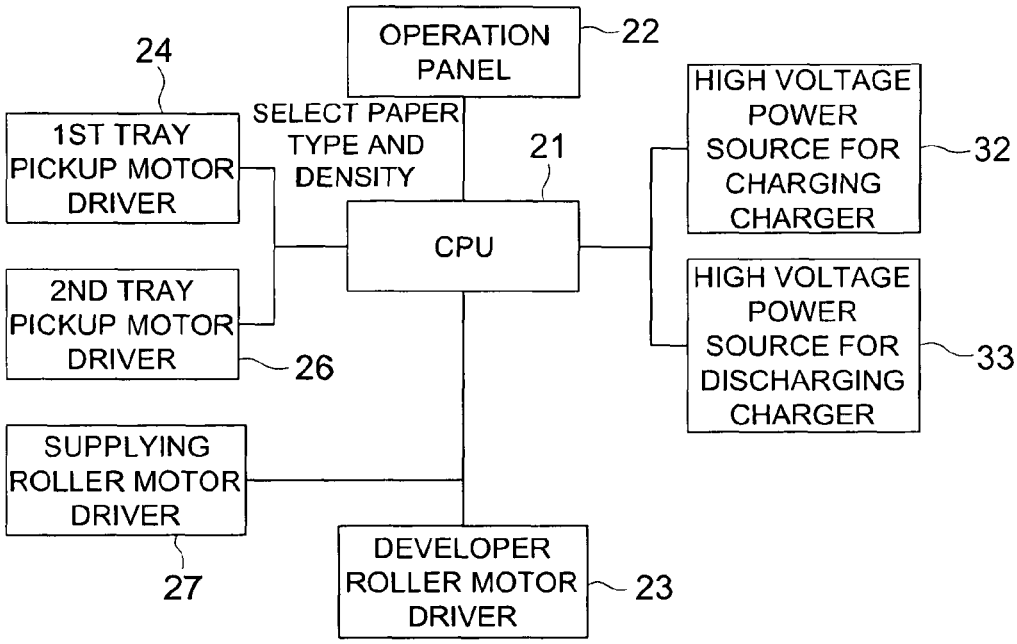
FIG. 13 is a block diagram showing a functional structure of control of charging and discharging of the developer layer in the wet development device according to the fourth embodiment of the invention.

FIG. 13 is a block diagram illustrating the functional structure of the control functions for charge and discharge of the developer layer on the developing roller in the wet development device according to the fourth embodiment. The structural elements each attached with the same sign as in the first to third embodiments are the same as those in the functions thereof.

The operator selects the recording paper on the operation panel, and the CPU 21 obtains the type of the selected paper. The CPU 21 functions as a recording sheet type obtaining section. The operator also can control the image density on the operation panel 22. The CPU 21 also obtains the density to set the amount of toner for development depending on the image density. Namely, the CPU 21 functions as a developing toner amount setting section for setting the amount of toner for development depending on the type of recording paper.

The CPU 21 decides the necessary amount of toner on the developing roller 41 depending on the determined amount of toner for development and sets the rotation speed of the supplying roller 52 by calculating back from the necessary amount of toner for development.

The supplying roller driver 27 is a device for driving the supplying roller 52 at a set rotation speed. The CPU 21 instructs the rotation speed to the supplying roller motor driver 27 for driving the supplying roller 52 to attain the determined amount of toner for development.

Similarly to the first and second embodiments, the CPU 21 performs the operation for changing the output of the developer charging section so that the determined amount of toner for development is supplied onto the photoconductor. The CPU 21 functions as a control section.

The first tray pickup motor driver 24 and the second tray pickup motor driver 25 are each the same as that in the case of the second embodiment.

<Control Flow of Charge and Discharge>

Figure 12:
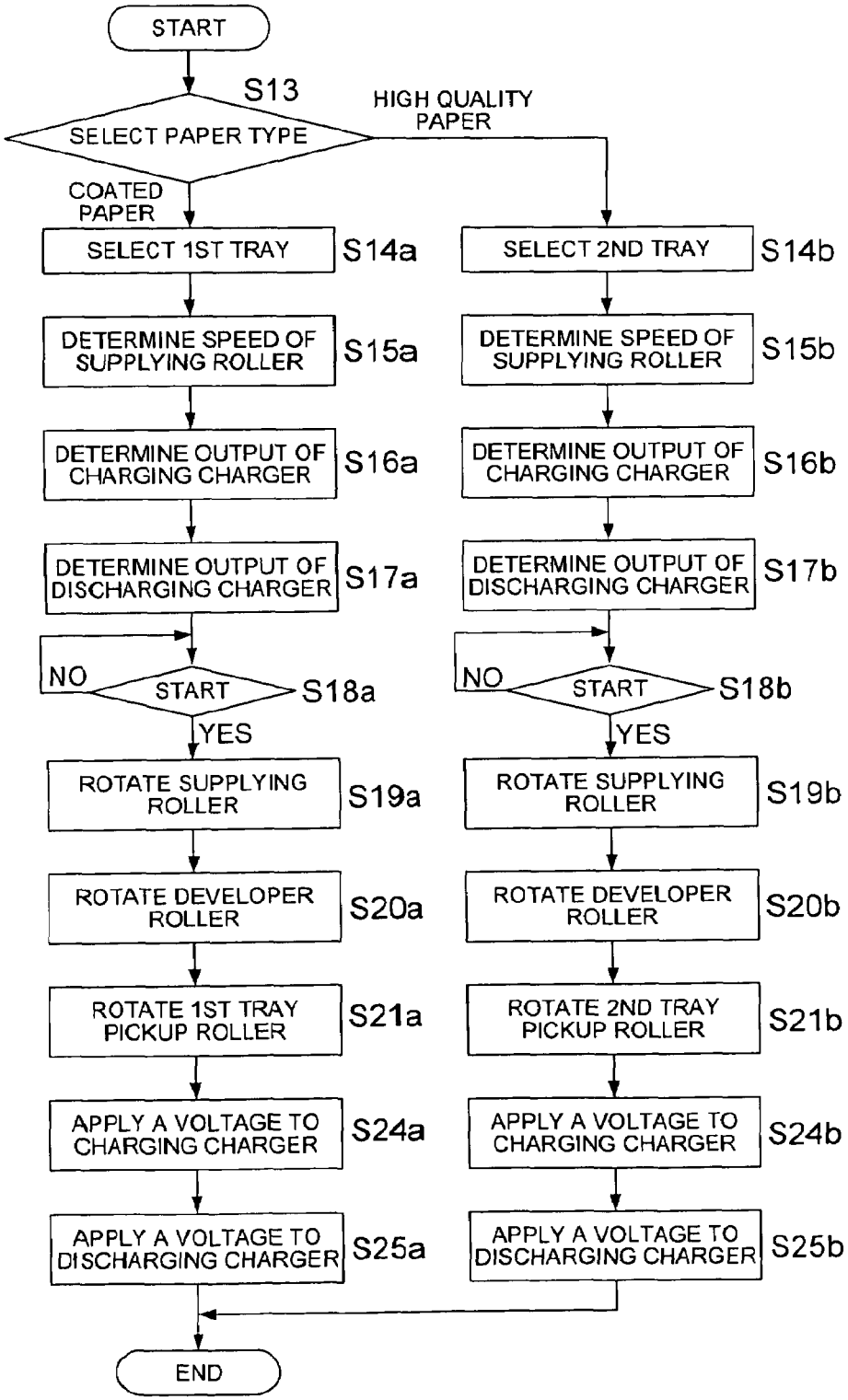
FIG. 12 is a flowchart showing a control flow of charge and discharge of the developer layer in the wet development device according to the fourth embodiment of the invention.

The control flow of the charge and the discharge is described referring to FIG. 12. FIG. 12 is a flowchart illustrating the flow of the controlling of the charge and discharge of the developer layer on the developing roller in the wet development device according to the fourth embodiment.

In step S13, the CPU 21 judges the type of recording paper that the user selected on the operation panel 22, and the CPU obtains the type of recording paper. The CPU 21 also sets the amount of toner for development toner depending on the obtained type of paper.

Step S14*a* and the following steps are performed when the paper selected in step S13 is coated paper, and step S14*b* and the following steps are performed when the selected paper is high quality paper. In the following description of the flow, coated paper represented by "a" and high quality paper represented by "b" are collectively described, and "a" and "b" are attached only when they are necessarily to be distinguished.

In step S14, the CPU 21 selects the first tray (in the case of coated paper) or the second tray (in the case of high quality paper) to supply the paper depending on the obtained type of recording paper.

In step S15, the CPU 21 determines the rotation speed of the supplying roller 52 depending on the determined amount of toner for development.

In step S16, the CPU 21 decides the output of the charging charger 42 depending on the determined rotation speed of the supplying roller 52.

In step S17, the CPU 21 determines the output of the discharging charger 43 depending on the determined output of the charging charger 42.

In step S18, the CPU 21 judges whether the operator operates the operation panel 22 to start image formation, and CUP 21 obtains the start-signal when the start of image formation is instructed. When the start of image formation is not instructed, the CPU 21 repeats step S18 and wait for an operation of the operator.

In step S19, the CPU 21 controls the supplying motor driver 27 in response to the start-signal to start the drive of the supplying roller 52 at the determined rotation speed.

In step S20, the CPU 21 controls the developing roller motor driver 23 to start the driving of the developing roller 41.

In the case of "a", the CPU 21 controls the first tray pickup motor driver 24 in step S21 to rotate the first tray pickup roller to start supply of the coated paper.

In the case of "b", the CPU 21 controls the second tray pickup motor driver 25 in step S21 so as to rotate the second tray pickup roller to start supply of the high quality paper.

In step S24, the CPU 21 settles the voltage of a high voltage power source 32 for the charging charger according to the decided output of the charging charger 42 and controls so as to apply the voltage to the charging charger 42.

In step S25, the CPU 21 settles the voltage of a high voltage power source 33 for the discharging charger according to the decided output of the discharging charger 43 and controls so as to apply the voltage to the charging charger 43.

As shown in the above, the control flow of the charge and the discharge of the developer layer on the developing roller is performed. After that, the operation may be finished with any optional process executed.

The Fifth Embodiment

Structure and Functions of Wet Development Device

The structure and the functions of the wet development device 4 in FIG. 11 according to the fifth embodiment of the invention are described below.

The fourth embodiment has the structure in which the drawing up roller and the supplying roller, and the liquid developer is supplied onto the developing roller. In the fifth embodiment, the charging charger 42 as the developing discharging section is arranged to face the supplying roller 52.

In such structure, the amount of the developer layer supplied on the developing roller can be controlled, and the supplying amount of the carrier liquid can be reduced by mainly supplying the toner onto the developing roller. Therefore, it can be made possible to supply the toner-rich developer for development and the carrier liquid on the developing roller can be reduced.

Figure 14:
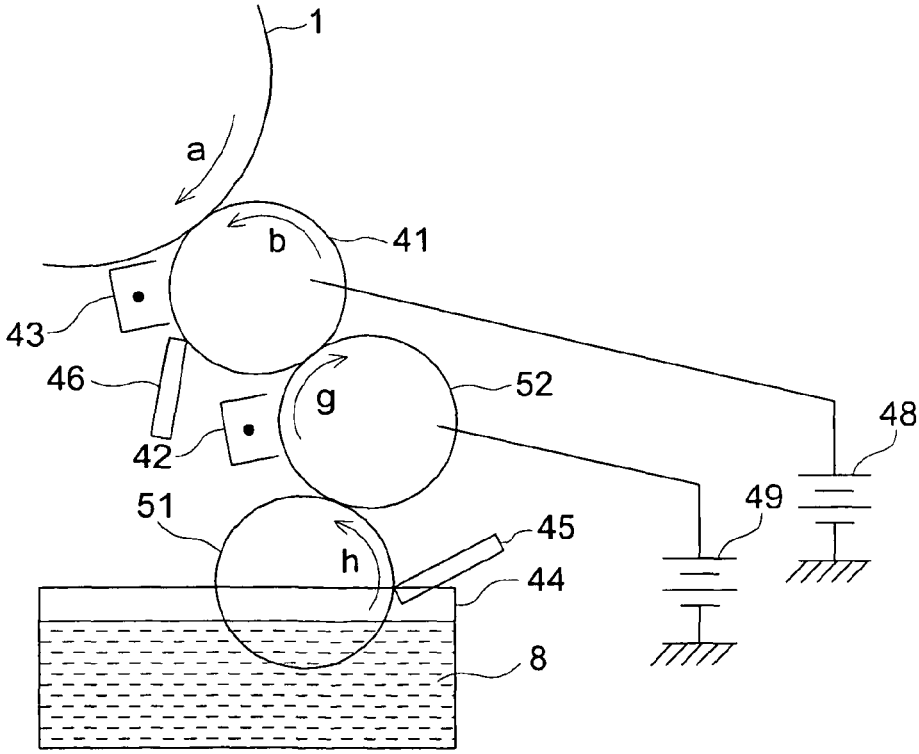
FIG. 14 is a diagram showing the schematic structure of a wet development device according to a fifth embodiment of the invention.

FIG. 14 is a schematic diagram illustrating the wet development device according to the fifth embodiment of the invention. The structure and the functions of the wet development device according to the fifth embodiment are described below referring to FIG. 14.

To the structural elements each having the same function as those in the first to fourth embodiments, the same reference numerals as in the first to forth embodiments are assigned, respectively. The structure and functions different from those in the first to fourth embodiments are described below.

In the wet development device in FIG. 14, the supplying roller 52 for supplying the developer onto the developing roller 41 and the drawing up roller 51 for drawing up the liquid developer 8 in the developer tank 44 are provided additionally to the developing roller 41 as the same as in the fourth embodiment in FIG. 11.

In the wet development device according to the fifth embodiment, however, the rotating direction of the supplying roller 52 and that of the drawing up roller 51 are different from the case of the fourth embodiment in FIG. 11.

In accordance with that, the arrangement of the regulation member 45 in contact with the drawing up roller 51 is different. Moreover, a power source 49 for applying voltage to transfer the toner to the developing roller 41 from the surface of the supplying roller 52 is connected to the supplying roller 52.

The drawing up roller 51 is arranged to be immersed in the liquid developer 8 in the developer tank 44 and draws up the liquid developer 8 from the developer tank 44 by rotating in the direction of "h". The drawn up developer 8 is transported while regulating by the regulating member 45 and transferred to the supplying roller 52.

The supplying roller 52 is arranged to face the drawing up roller 51 and rotated in the direction of the arrow "g" while touching with the drawing up roller 51. The toner in the developer transferred to the surface of supplying roller 52 at the nip portion is charged by the charging charger 42 as the developer charging section arranged to face the supplying roller 52.

The developer containing the charged toner on the supplying roller 52 is transported to the nip portion with the developing roller 41.

The developing roller 41 as the developer carrier is arranged to face the supplying roller 52 and rotated in the direction of the arrow "b" while touching with the supplying roller 52. Therefore, the surface moving direction at the nip portion is the same as that of the supplying roller 52, and the toner layer transported on the surface of supplying roller 52 is entirely transferred onto the surface of developing roller 41 by the electric field between these rollers at the nip portion.

Such a situation is the same as that of the development on the photoconductor surface, and as shown in FIG. 2, the liquid developer is divided into two portions each on the developer roller and the supplying roller after the toner is moved onto the developing roller, and the carrier liquid is alone left on the surface of the supplying roller having passed the nip portion.

Accordingly, the carrier liquid on the developing roller is reduced, and the carrier liquid consumed for the development is also reduced. The toner-rich developer on the developing roller 41 is transported to the nip portion, between the developer roller and the photoconductor drum 1, to be used for development.

The carrier liquid adhering to the supplying roller 52 is reused. A blade for recovering the carrier liquid may be provided in touch with the supplying roller 52.

The control of the image density can be performed by controlling the output of the charging charger 42. In such a case, the charging amount of the toner in the liquid developer on the surface of the supplying roller 52 is changed since the charging charger 42 is faced to the supplying roller 52. However, the problem is solved by applying voltage necessary to entirely transfer the developer on the supplying roller 52 to the developer roller 41 side even when the charging amount of the toner is high.

When the charging amount of the toner in the developer is changed by controlling the output of the charging charger, the output of the discharging charger 43 should be accordingly changed to keep the ability of cleaning the developer remaining after the development.

<Functional Structure>

Figure 16:
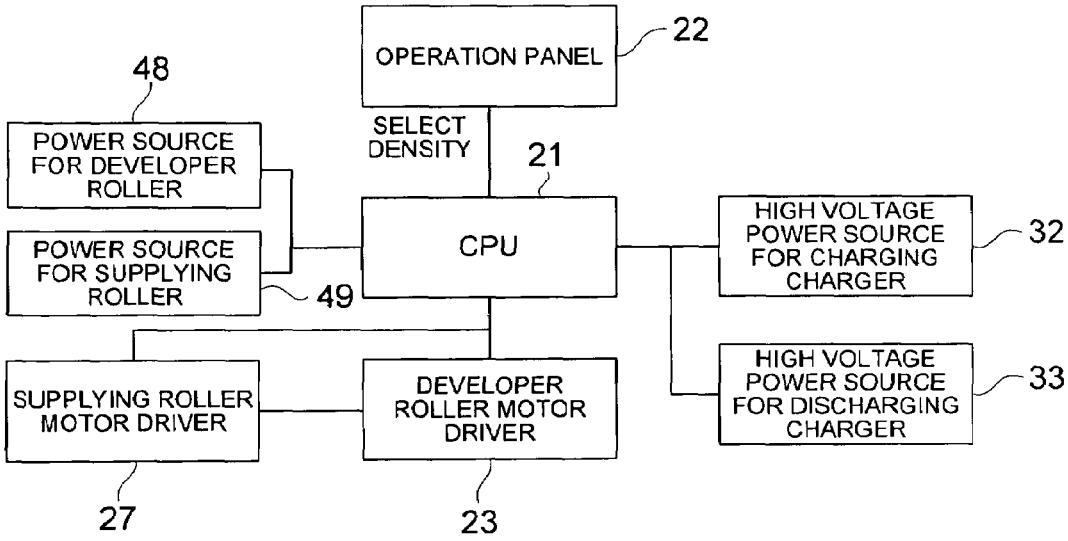
FIG. 16 is a block diagram showing the functional structure of control of charging and discharging of the developer layer in the wet development device according to the fifth embodiment of the invention.

FIG. 16 is a block diagram illustrating the functional structure of the controlling functions for charge and discharge of the developer layer on the developing roller in the wet development device according to the fifth embodiment. The structural elements each attached with the same reference numeral as in the first to fourth embodiments are the same as those in the functions thereof.

The image density is selected by the operator on the operation panel 22. The CPU 21 sets the amount of toner for development corresponding to the selected image density. The CPU 21 functions as a developing toner amount setting section for setting the amount of toner for development.

Similarly to the first to fourth embodiments, the CPU 21 performs and controls the action to change the output of the developer charging section so as to meet the amount of toner for development supplied onto the photoconductor with the set developing toner amount.

The power source 49 for supplying roller applies voltage to the supplying roller. The voltage is set in such a way that the developer on the supplying roller 52 is entirely transferred onto the developing roller 41 by the electric field between these rollers caused by the relation of the voltage applied to the developing roller by the power source for developing roller 48.

<Control Flow of Charge and Discharge>

Figure 15:
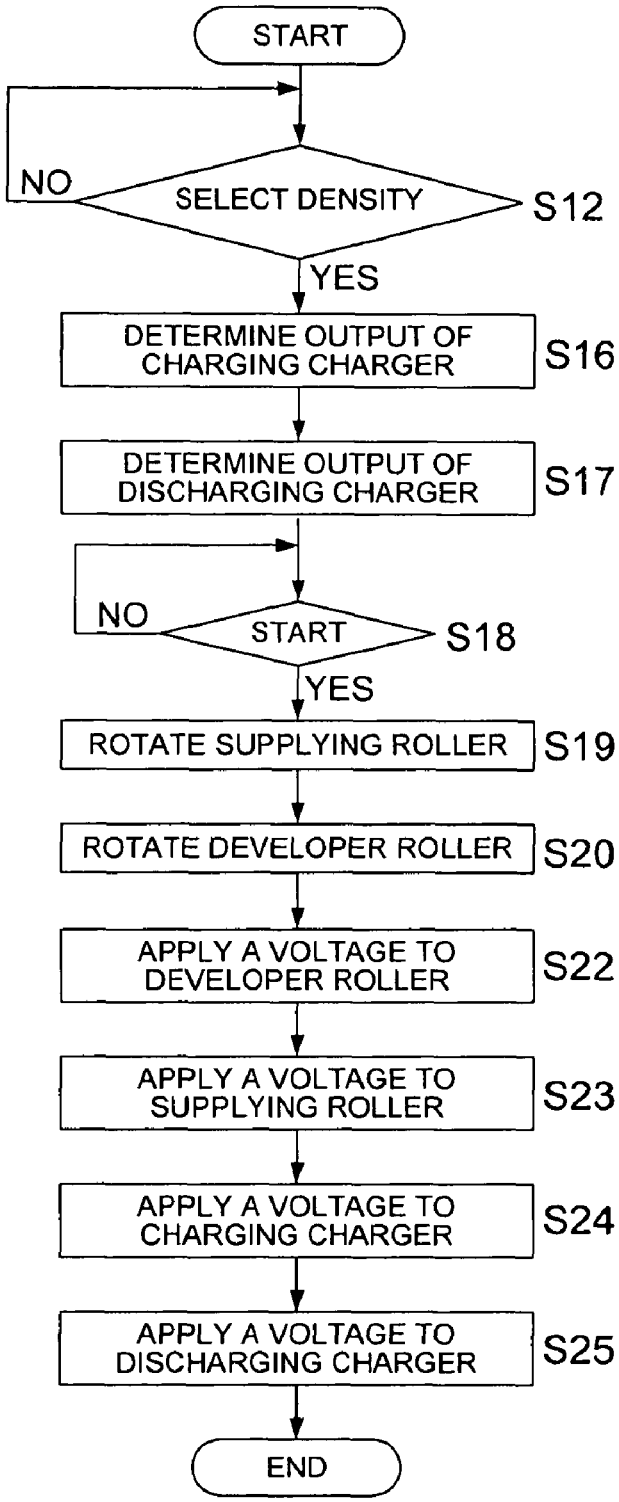
FIG. 15 is a flowchart showing a control flow of charge and discharge of the developer layer in the wet development device according to the fifth embodiment of the invention.

The control flow of the charge and the discharge is described referring to FIG. 15. FIG. 15 is a flowchart illustrating the flow of controlling of the charge and discharge of the developer layer on the developing roller in the wet development device according to the third embodiment.

The CPU 21 judges in step S12 whether the operator operates the operation panel 22 to select the density, and obtains the selection signal when the density selection is carried out and sets the amount of toner for development corresponding to the selected density. When the operation for density selection is not performed, the CPU 21 repeats step S12 and waits for an operation by the operator.

In step S16, the CPU 21 decides the output of the charging charger 42 corresponding to the set developing toner amount.

In step S17, the CPU 21 decides the output of the discharging charger 43 corresponding to the decided output of the charging charger 42.

In step S18, the CPU 21 judges whether the image formation is started by the operation of the operator on the operation panel, and obtains the start-signal when the image formation is started. When the operation to start is not carried out, the CPU 21 repeats step S18 and waits for an operation by the operator.

In step S19, the CPU 21 controls the supplying motor driver 27 in response to the start-signal to start the drive of the supplying roller 52 at the set rotation speed.

In step S20, the CPU 21 controls the developing roller motor driver 23 to start the driving of the developing roller 41.

In step S22, the CPU 21 controls the power source for developing roller 49 to apply the decided voltage to the supplying roller 52.

In step S23, the CPU 21 controls the power source for developing roller 48 to apply the decided voltage to the developing roller 41.

In step S24, CPU sets the voltage of the high voltage power source 32 for the charging charger corresponding to the decided output of the charging charger 42 and controls the power source to apply the set voltage to the charging charger 42.

In step S25, CPU sets the voltage of the high voltage power source 33 for the discharging charger corresponding to the decided output of the discharging charger 43 and controls the power source to apply the set voltage to the discharging charger 43.

As described above, the control flow of the charge and the discharge of the developer layer on the developing roller is performed. After that, the operation may be finished with any optional process executed.

Sixth Embodiment

Structure and Functions of Wet Development Device

The structure and functions of the wet development device according to the sixth embodiment of the invention different from those of the fifth embodiment are described referring to FIG. 14.

The structure in which the operator controls the image density through the operation panel is described in the fifth embodiment. The sixth embodiment is constituted so that the settling of the amount of toner for development can be changed corresponding to the type of paper. It is different point from the fifth embodiment that the function of practically changing the amount of toner for development corresponding to the set amount is performed by changing the rotation speed of the supplying roller 52 in the same way as in the fourth embodiment.

Consequently, the output of the developer discharging section and that of the developer discharging section are controlled corresponding to the rotation speed of the supplying roller 52.

For instance, in the case of the amount of toner for development is increased by increasing the rotation speed of the supplying roller 52, the time for passing the area of the charging charger 42 is shortened even though the toner amount on the supplying roller 52 is constant regardless of the rotation speed of the supplying roller 52. On this occasion, the charging amount of the toner particles is lowered when the output of the charging charger is the same.

Accordingly, the output of the charging charger 42 is necessarily changed corresponding to the rotation speed of the supplying roller 52 for obtaining the set amount of toner charge.

The developer charged by the controlled output is transported to the nip portion with the developing roller 41 and transferred to the developing roller by the force of electric field. Thus, the thin layer of the toner particles charged at the definite level is formed on the developing roller 41 even though the adhering amount is changed.

However, the electric current for eliminating the charge of the toner particles is different since the adhering amount of developing is different even when the charging amount is the same. Consequently the output of the discharging charger is necessarily raised accompanied with increasing of the adhering toner amount.

In an concrete example of the coated paper in which the amount of the developing toner is set at 1.5 g/m$^2$, a rotation speed of the supplying roller 52 of 440 mm/s in line speed, an output of charging charger 42 of 40 μA and an output of discharging charger of 30 μA are appropriate. Besides, In the case of the high quality paper, the amount of toner for development and the rotation speed of the supplying roller 52 become each 2.5 g/m$^2$ and 730 mm/s in line speed, respectively. Corresponding to that, an output of the charging charger 42 of 70 μA and that of the discharging charger 43 of 50 μA are required.

<Functional Structure>

Figure 18:
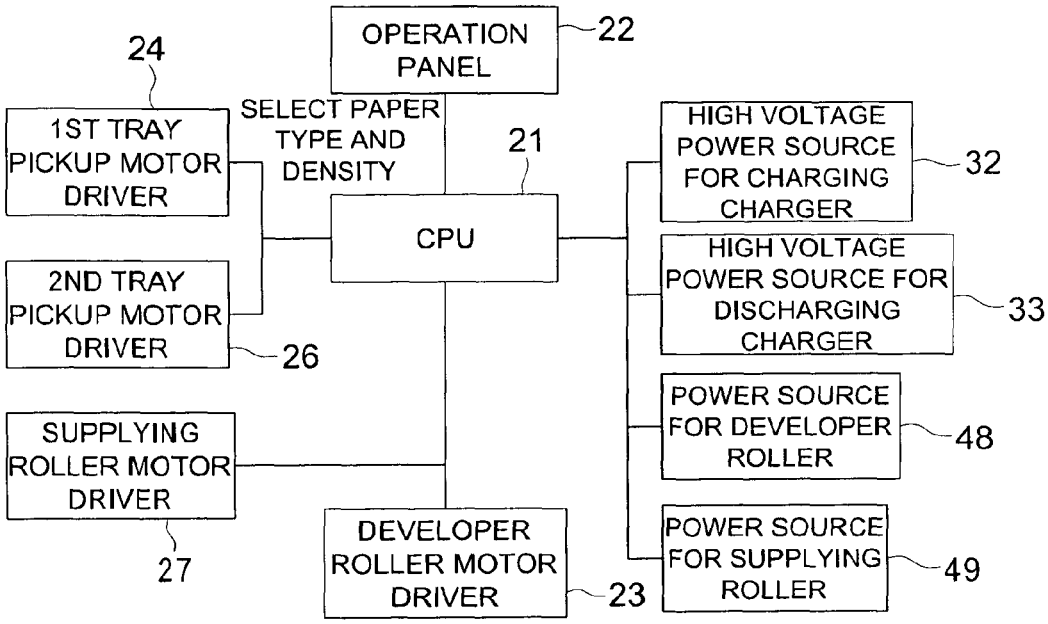
FIG. 18 is a block diagram showing the functional structure of control of charging and discharging of the developer layer in the wet development device according to the sixth embodiment of the invention.

FIG. 18 is a block diagram showing the functional structure of the charge and the discharge of the developer layer in the wet development device relating the sixth embodiment. The structural element attached with the sign the same as in the first embodiment has the same function as those in the first to fifth embodiments.

The operator selects the type of recording paper through the operation panel and the CPU 21 obtains the information of the paper type. The CPU functions as a recording sheet type obtaining section. The operator can also control the image density through the operation panel 22 and the CPU 21 obtains the information of the image density control together with that of the recording paper and set the amount of toner for development. On this occasion, the CPU 21 functions as a developing toner amount settling section for settling the amount of toner for development depending on the type of recording paper.

The CPU 21 calculates the toner amount necessary on the developing roller 41 from the defined developing toner amount and sets the rotation speed of the supplying roller 52 supplying the toner by calculating back from the required toner amount.

The supplying roller motor driver 27 is a device for driving the supplying roller 52 at the instructed rotation speed. The CPU 21 instructs the rotation speed to the supplying roller motor driver 27 to drive the supplying roller 52 for attaining the amount of the set developing toner amount.

Similarly to the first to fifth embodiments, the CPU 21 performs and controls the action to change the output of the developer charging section so as to meet the amount of toner for development supplied onto the photoconductor with the set developing toner amount. The CPU 21 functions as a control section as described above.

The first tray pickup motor driver 24 and the second tray pickup motor driver 25 are each the same as those in the case of the fourth embodiment.

<Control Flow of Charge and Discharge>

Figure 17:
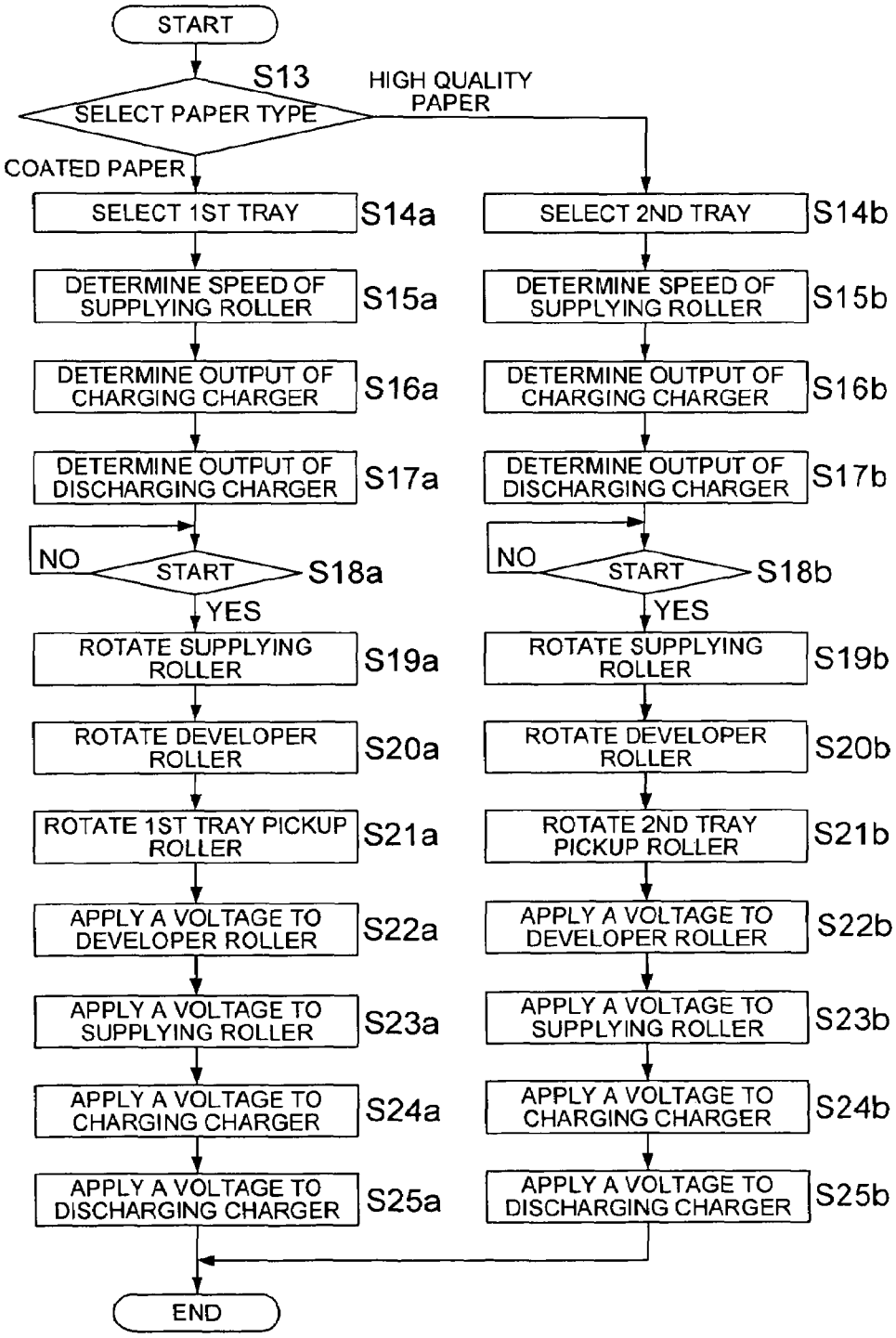
FIG. 17 is a flowchart showing a control flow of charge and discharge of the developer layer in the wet development device according to a sixth embodiment of the invention.

The control flow of the charge and the discharge is described referring to FIG. 17. FIG. 17 is a flowchart illustrating the flow of the charge and the discharge of the developer layer in the wet development device according to the sixth embodiment of the invention.

In step S13, the CPU 21 judges the type of recording paper selected by the operation on the operation panel by the operator and obtain the input. The CPU 21 also set the amount of toner for development depending on the obtained type of paper.

The step of 14*a* and the followings are performed when the paper selected in step 13 is coated paper, and the step 14*b* and the followings are performed when the selected paper is high quality paper. In the following description of the flow, the coated paper "a" and the high quality paper "b" are collectively described and "a" and "b" are attached only when they are necessarily distinguished.

In step S14, the CPU 21 selects the first tray (in the case of coated paper) or the second tray (in the case of the high quality paper) for supplying the paper depending on the obtained type of recording paper.

In step S15, the CPU 21 decides the rotation speed of the supplying roller 52 corresponding to the set amount of developing developer.

In step S16, the CPU 21 decides the output of the charging charger 42 corresponding to the set rotation speed of the supplying roller 52.

In step S17, the CPU 21 decides the output of the discharging charger 43 corresponding to the decided output of the charging charger 42.

In step S18, the CPU 21 judges that the operator operates the operation panel 22 to start image formation or not, and CUP 21 obtains the start-signal when the start of image formation is carried out. When the image formation start is not instructed, the CPU 21 repeats the previous operation and wait for next operation by the operator.

In step S19, the CPU 21 controls the supplying motor driver 27 in response to the start-signal to start the drive of the supplying roller 52 at the set rotation speed.

In step S20, the CPU 21 controls the developing roller motor driver 23 so as to start the driving of the developing roller 41.

In the case of "a", the CPU 21 controls the first tray pickup motor driver 24 in step S21 so as to rotate the first tray pickup roller to start supply of the coated paper.

In the case of "b", the CPU 21 controls the second tray pickup motor driver 25 in step S21 so as to rotate the second tray pickup roller to start supply of the high quality paper.

In step S22, the CPU 21 controls the power source 49 for the supplying roller 52 so as to apply the designated voltage.

In step S23, the CPU 21 controls the power source 48 for the developing roller 41 so as to apply the designated voltage.

In step S24, the CPU 21 sets the voltage of a high voltage power source 32 for the charging charger corresponding to the decided output of the charging charger 42 and controls so as to apply the voltage to the charging charger 42.

In step S25, the CPU 21 sets the voltage of a high voltage power source 33 for the discharging charger 43 corresponding to the decided output of the discharging charger 43 and controls so as to apply the voltage to the charging charger 43.

As in the above, the control flow of the charge and the discharge to the developer layer on the developing roller is performed. After that, the operation may be finished with any optional process executed.

The toner in the developer can be charged at an arbitrary charging amount by the charging section and subjected to development on the occasion of development by the liquid developer by the wet development device according to the embodiments of the invention. In such a case, satisfactory cleaning of the toner remaining on the developing roller can be performed by using the blade by discharging the charge of the toner on the developer by that the discharging section is provided before the cleaning of the developing roller and the output of which is appropriately controlled corresponding to the output of the charging section The cleaning can be sufficiently carried out and good image can be obtained without contamination of the toner and the wear of the blade and the developing roller can be reduced even when the amount of toner for development or the charging amount of the toner is changed to change the density or gradation of image or the type of recording sheet.

EXAMPLES

Examples of the wet development device and developing method according to the first to sixth embodiments are described below.

In Examples 1 to 6, the wet development devices and developing method each according to the first to sixth embodiments are used, respectively.

In Comparative Examples 1 to 6, the wet developing devices described in the first to sixth embodiments are each used but the control of the output of the developer discharging section corresponding to the output of the discharging section for the developer is not performed.

Conditions commonly applied for each of the examples are described below.

<Preparation of Liquid Developer>

In a Henschel mixer, 100 parts by mass of polyester resin, 15 parts by mass of copper phthalocyanine were satisfactorily mixed and then melted and kneaded by a same direction rotating bi-axial extruder at an inner temperature of 100° C. The resultant mixture was cooled and roughly crushed to obtain a roughly crushed toner.

Seventy five parts by mass of Moresco White P40, manufactured by Matsumura Oil Lab., 0.8 parts by mass of V220, manufactured by ISP Co. Ltd., as a dispersing agent were mixed and crushed for 4 days in a sand mill under wet condition to prepare a liquid developer. The particle diameter was 2.0 μm. The particle diameter was measured by a laser diffraction type particle size distribution measuring apparatus SALD-2200 manufactured by Shimadzu Corp. The charge holding rate of the liquid developer was measured, which was 90%.

The particle diameter and the charge holding rate of a liquid developer prepared by adding 1.5 parts by mass of the dispersing agent V220, manufactured by ISP Co. Ltd., were each 1.9 μm and 60%, respectively.

The evaluation of the charge holding ratio is described below referring to FIG. 19.

Figure 19:
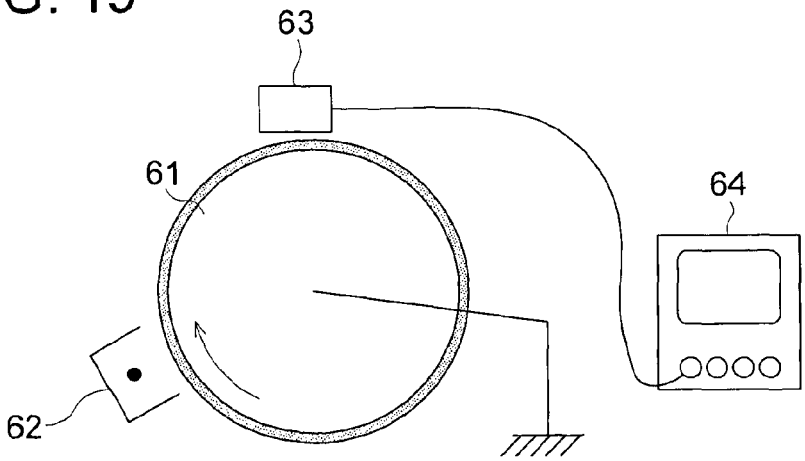
FIG. 19 is a diagram illustrating an evaluation method of charge maintaining ability of the developer.

In FIG. 19, reference numeral 61 is a metal roller having a diameter of 100 mm and a width of 100 mm, which is grounded. A thin layer of the liquid developer of 6 g/m$^2$ is formed by a bar coater. After that, the roller 61 is rotated once at a rate of 420 mm/s while donating charge by a corotron charger 62. A constant current power source Model 610E, manufactured by Trek Inc., is connected to the corotron charger 62. The power source is controlled at the constant current so that an electric current of 20 μA (width of 8 cm) is flown into the roller 61.

Reference numeral 63 is a surface potential sensor Model 344, manufactured by Trek Inc., which measures the surface potential of the toner after 0.5 seconds and 10 seconds of charging of the toner layer on the roller 61. The surface potential sensor 63 is connected with an oscilloscope Model 1640, manufactured by Yokogawa Electric Corp., and the measuring result of the surface potential is read on the oscilloscope 64.

The charging amount of the toner particle decreases with time after being charged. Therefore, the charge holding rate is defined according to the following expression.

Charge holding rate=(Surface potential after 10 second/Surface potential after 0.5 second)×100(%)

<Condition of Apparatus>

An electro-conductive polyurethane rubber roller having an outer diameter of 40 mm, a length of 230 mm and a surface roughness (Rz of JIS) of 2 μm was used as the developing roller, and two corotron chargers were used each as the charging charger 42 and the discharging charger 43. A polyurethane blade having a thickness of 2 mm and a hardness degree of 77 was used as the cleaning member 46 at a contacting angle of 20° and a contacting pressure of 20 N/m.

In Examples 1 to 3, the developing roller 41 was grounded and rotated at a line speed of 420 mm/s, and a developer thin layer having a toner amount of 2.5 g/m$^2$ (developer amount of 10 g/m$^2$) was formed on the developing roller 41. The cleaning property was evaluated after that the toner particles were charged under such a condition by the charging charger 42 and then the charge was eliminated after the development by the discharging charger 43.

The output of the charging charger 42 and that of the discharging charger 43 were each constantly controlled in the electric current flown into the developing roller by a constant current power source Model 610E, manufactured by Trek Inc.

In Examples 4 to 6, a 180 lines/inch diagonal line type anix roller was used as the drawing up roller 51 and an electro-conductive polyurethane rubber roller was used as the supplying roller 52. As the developing roller 41, the same roller as in Examples 1 to 3 was also used.

The rubber roller is not limited to polyurethane and rubber materials of NBR and others may be used. The anix roller may be replaced by one of other types different in shape of the hollowed portion or in line number.

The sinking depth of the drawing up roller 51 with the supplying roller 52 was 0.4 mm, and that of the supplying roller with the developing roller was 0.1 mm. The line speed of the developing roller was 420 mm/s.

In such a case, the line speed of the supplying roller 52 was set at the values described in Table 1 for forming the developer thin layer having the toner amount of 2.5 g/m$^2$ or 1.5 g/m$^2$ on the developing roller 41.

The cleaning property was evaluated by donating charge to the toner particles by the charging charger 42 and discharging the charge by the discharging charger 43 under the above conditions.

The output of the charging charger 42 and that of the discharging charger 43 were controlled in the same manner as in Examples 1 to 3. The electric current values in each of the examples are shown in table 1.

<Method and Results of Evaluation>

The evaluation on the cleaning property as to Examples 1 to 6 was carried out as follows.

The developer remaining on the surface of the developing roller 41 after passing through the cleaning member (blade) to remove the remaining on the developing roller 41 was peeled by a tape (Mending Tape manufactured by 3M) and the tape was fixed on paper base for visual evaluation. The evaluation results were classified into two ranks A and B. Rank A means good or acceptable and B means not good or unacceptable.

The test conditions and the evaluation results of the cleaning property in Examples 1 to 6 and Comparative Examples 1 to 6 are listed in Table 1.

TABLE 1

| | Apparatus structure | Paper type | Set amount of toner for developmet (g/m$^2$) | Supplying roller speed (mm/s) | Developer amount on developing roller (g/m$^2$) | Charge output (μA) | Discharge output (μA) | Cleaning property |
|---|---|---|---|---|---|---|---|---|
| Example 1 | First | *1 | 1.5 | None | 10.0 | 110 | 70-90 | A |
| | embodiment | *2 | 2.5 | None | 10.0 | 70 | 40-60 | A |
| Example 2 | Second | *1 | 1.5 | None | 10.0 | 110 | 80 | A |
| | embodiment | *2 | 2.5 | None | 10.0 | 70 | 50 | A |
| Example 3 | Third | *1 | 1.5 | None | 10.0 | 110 | 80 | A |
| | embodiment | *2 | 2.5 | None | 10.0 | 70 | 50 | A |
| Example 4 | Fourth | *1 | 1.5 | 440 | 6.0 | 40 | 30 | A |
| | embodiment | *2 | 2.5 | 730 | 10.0 | 70 | 50 | A |
| Example 5 | Fifth | *1 | 1.5 | 730 | 5.0 | 110 | 80 | A |
| | embodiment | *2 | 2.5 | 730 | 8.3 | 70 | 50 | A |
| Example 6 | Sixth | *1 | 1.5 | 440 | 4.5 | 40 | 30 | A |
| | embodiment | *2 | 2.5 | 730 | 8.3 | 70 | 50 | A |
| Comp. 1 | First embodiment | *1 | 1.5 | None | 10.0 | 110 | 50 | B |
| Comp. 2 | Second embodiment | *1 | 1.5 | None | 10.0 | 110 | 50 | B |

TABLE 1-continued

| | Apparatus structure | Paper type | Set amount of toner for developmet ($g/m^2$) | Supplying roller speed (mm/s) | Developer amount on developing roller ($g/m^2$) | Charge output (μA) | Discharge output (μA) | Cleaning property |
|---|---|---|---|---|---|---|---|---|
| Comp. 3 | Third embodiment | *1 | 1.5 | None | 10.0 | 110 | 50 | B |
| Comp. 4 | Fourth embodiment | *1 | 1.5 | 440 | 6.0 | 40 | 50 | B |
| Comp. 5 | Fifth embodiment | *1 | 1.5 | 730 | 5.0 | 110 | 50 | B |
| Comp. 6 | Sixth embodiment | *1 | 1.5 | 440 | 4.5 | 40 | 50 | B |

*1: Coated paper,
*2: High quality paper,
Comp.: Comparative Example

In all examples, the amount of toner for development is set at 2.5 $g/m^2$ or 1.5 $g/m^2$, The toner amounts were differentiated to form images of different density or to assume the cases of coated paper and high quality paper.

Appropriate cleaning properties were obtained in all Examples 1 to 6, namely in the first to sixth embodiments, as to the both of the different toner amounts.

In Comparative Examples, the amount of toner for development was set at 1.5 $g/m^2$. However, the output of the discharging charger was the same as that for the amount of toner for development of 2.5 $g/m^2$.

Appropriate cleaning property was not obtained in any of Comparative Examples 1 to 6, namely in the first to sixth embodiments. It is understood that in the case of the different amount of toner for development the good effect on the cleaning property is not obtained by simply discharging with the output of the discharging charge not being appropriate to that toner amount.

As described above, when the wet development device, the developing method and the image forming apparatus having the device according to the invention are used to perform development using the liquid developer, the toner in the developer can be charged at an arbitrary charging amount by the charging section, to be subjected to development. In such a case, by providing the discharging section before the cleaning and by appropriately controlling the output of the discharging section corresponding to the output of the discharging section, the cleaning of the developer remaining on the developing roller can be satisfactorily carried out by using the blade.

Therefore, appropriate cleaning can be performed, the wear of the blade or developing roller can be reduced and good images can be obtained without toner contamination even when the amount of toner for development or the toner charging amount is changed for changing the density and gradation of image or the type of paper.

The above-described embodiments are only examples and not imitating in any point. The scope of the invention is shown by the claims and not by the above mentioned description, and it is intended that variations within the means and scope equivalent to the claims are included.

What is claimed is:

1. A wet development device, comprising:

a developer carrying member configured to convey thereon a liquid developer for developing an electrostatic latent image on an surface of an image carrying member into a toner image, to a developing area, the liquid developer containing the toner and carrier liquid;

a developer charging section which is configured to output a variable current and is provided on an upstream side with respect to the developing area in a moving direction of the developer carrying member so that the toner in the developer is charged before being subjected to development;

a developer discharging section which is configured to output a variable current and is provided on a downstream side with respect to the developing area in the moving direction of the developer carrying member so that the toner in the developer remaining on the developer carrying member is discharged after being subjected to the development;

a liquid developer removing section which is provided on a downstream side with respect to the developer discharging section in the moving direction of the developer carrying member and is configured to remove the liquid developer left on the developer carrying member after the toner is discharged by the developer discharging section; and a control section configured to change a value of the variable current outputted by the developer discharging section depending on a change of a value of the variable current being outputted by the developer charging section.

2. The wet development device of claim 1, comprising:

a developing toner amount setting section for setting in advance a developing toner amount which is an amount of toner to be transferred onto the image carrying member at a time of the developing of the electrostatic latent image, wherein the control section sets the value of the variable current outputted by the developer charging section and the value of the variable current outputted by the developer discharging section depending on the developing toner amount set by the developing toner amount setting section.

3. The wet development device of claim 2, comprising:

a recording sheet type obtaining section for obtaining a sheet type of a recording sheet onto which the toner image formed on the image carrier is transferred, wherein the developing toner amount setting section sets the developing toner amount based on the sheet type obtained by the recording sheet type obtaining section.

4. The wet development device of claim 1, comprising:

a developer supplying section for supplying an amount of the liquid developer to the developer carrying member, wherein the control section sets the value of the variable current outputted by the developer charging section and the value of the variable current outputted by the developer discharging section depending on an amount of the developer supplied by the developer supplying section.

5. The wet development device of claim 4, wherein the developer charging section is disposed facing the developer supplying section to charge the toner in the liquid developer on the developer supplying section.

6. The wet development device of claim 1, wherein the control section is configured to increase or decrease the value of the variable current outputted by the developer discharging section in accordance with the value of the variable current being outputted by the developer charging section, respectively.

7. The wet development device of claim 1, wherein the control section is configured to change the value of the variable current outputted by the developer charging section, and the value of the variable current outputted by the developer discharging section is changed depending on the change of the value of the variable current being outputted by the developer charging section.

8. The wet development device of claim 1, wherein the developer discharging section is disposed such that the developer discharging section is off a surface of the liquid developer on the developer carrying member.

9. A wet development method, comprising the steps of:

charging toner in a liquid developer on a developer carrying member by supplying variable electric current, the liquid developer containing the toner and carrier liquid;

conveying on the developer carrying member the liquid developer in which the toner has been charged in the step of charging toner, to a developing area;

developing an electrostatic latent image on a surface of an image carrying member into a toner image in the developing area, with the developer conveyed by the developer carrying member;

discharging the toner remaining in the liquid developer by supplying variable electric current, after the step of developing an electrostatic latent image; and removing the liquid developer remaining on the developer carrying member, after the step of discharging the toner, wherein the step of discharging includes the step of changing a value of the variable electric current supplied in the step of discharging the toner, depending on a change of a value of the variable electric current being supplied in the step of charging toner.

10. The wet development method of claim 9, comprising the step of:

setting in advance a developing toner amount which is an amount of toner used to develop the electrostatic latent image in the step of developing an electrostatic latent image, wherein the variable electric current supplied in the step of charging toner and the variable electric current supplied in the step of discharging the toner are set depending on the developing toner amount set in the step of setting a developer toner amount.

11. The wet development method of claim 10, comprising the step of:

obtaining a sheet type of a recording sheet onto which the toner image formed in the step of developing an electrostatic latent image, wherein in the step of setting a developing toner amount, the developing toner amount is set based on the sheet type, of the recording sheet, obtained in the step of obtaining a sheet type.

12. The wet development method of claim 6, comprising the step of:

supplying a variable amount of the liquid developer to the developer carrying member, wherein the variable electric current supplied in the step of charging toner and the variable electric current supplied in the step of discharging the toner are set depending on the amount of the liquid developer supplied in the step of supplying a variable amount of the liquid developer.

13. The wet development method of claim 12, wherein the step of charging toner is executed in or before the step of supplying a variable amount of the liquid developer.

14. The wet development method of claim 9, wherein the value of the variable electric current supplied in the step of discharging the toner is increased or decreased depending on the change of the value of the variable electric current being supplied in the step of charging toner.

15. The wet development method of claim 9, further comprising the step of:

changing the value of the variable electric current supplied in the step of charging toner, wherein the value of the variable electric current supplied in the step of discharging the toner is changed depending on the change of the value of the variable electric current being supplied in the step of charging toner.

16. The wet development method of claim 9, wherein in the step of discharging the toner, the variable electric current is supplied from a toner discharging section provided off a surface of the liquid developer on the developer carrying member.

17. An image forming apparatus, comprising:

an image carrying member for carrying thereon an electrostatic latent image; and a wet development device for developing the electrostatic latent image on the image carrying member into a toner image, the wet development device including:

a developer carrying member for conveying thereon a liquid developer for developing the electrostatic latent image to a developing area, the liquid developer containing the toner and carrier liquid;

a developer charging section which is configured to output a variable current and is provided on an upstream side with respect to the developing area in a moving direction of the developer carrying member so that the toner in the developer is charged before being subjected to development;

a developer discharging section which is configured to output a variable current and is provided on a downstream side with respect to the developing area in the moving direction of the developer carrying member so that the toner in the developer remaining on the developer carrying member is discharged after being subjected to the development;

a liquid developer removing section provided on a downstream side with respect to the developer discharging section in the moving direction of the developer carrying member for removing the liquid developer left on the developer carrying member after the toner is discharged by the developer discharging section; and a control section for changing value of the variable current outputted by the developer discharging section depending on a change of a value of the variable current being outputted by the developer charging section.

* * * * *